US006729483B1

(12) United States Patent
Nguyen et al.

(10) Patent No.: US 6,729,483 B1
(45) Date of Patent: May 4, 2004

(54) THERMOPLASTIC BAG DISPENSING SYSTEM

(76) Inventors: Hank D. Nguyen, 4929 Jenette St., Metairie, LA (US) 70003; Francis B. Galle, 1400 Butternut Ave., Metairie, LA (US) 70001

( * ) Notice: Subject to any disclaimer, the term of this patent is extended or adjusted under 35 U.S.C. 154(b) by 163 days.

(21) Appl. No.: 09/978,738

(22) Filed: Oct. 16, 2001

Related U.S. Application Data

(63) Continuation-in-part of application No. 09/596,768, filed on Jun. 19, 2000, now Pat. No. 6,505,750, which is a continuation-in-part of application No. 29/120,858, filed on Mar. 28, 2000, now Pat. No. Des. 435,379, and a continuation-in-part of application No. 29/120,859, filed on Mar. 28, 2000, now Pat. No. Des. 433,857.

(51) Int. Cl.[7] ..... A47F 7/00

(52) U.S. Cl. ..... 211/163; 211/12; 211/50; 211/59.1; 248/100; 206/554

(58) Field of Search ..... 211/163, 12, 59.1, 211/57.1, 50, 205; 206/554; 248/95, 97, 99, 100

(56) References Cited

U.S. PATENT DOCUMENTS

| | | | | |
|---|---|---|---|---|
| 1,657,737 | A | | 1/1928 | Bogren |
| 3,144,960 | A | | 8/1964 | Membrino |
| 3,190,490 | A | | 6/1965 | Membrino |
| 3,306,492 | A | | 2/1967 | Kugler |
| 3,361,294 | A | | 1/1968 | Bjerum |
| 3,918,589 | A | * | 11/1975 | Nausedas ..... 211/57.1 |
| 4,487,318 | A | | 12/1984 | Roen |
| 4,611,719 | A | * | 9/1986 | Dudek et al. ..... 211/50 |
| 4,932,560 | A | * | 6/1990 | Roen ..... 211/57.1 X |
| 5,332,097 | A | * | 7/1994 | Wile ..... 206/554 |
| 5,419,437 | A | * | 5/1995 | Huseman ..... 206/554 |
| 5,732,833 | A | | 3/1998 | Alvarado |
| 5,924,573 | A | * | 7/1999 | Piraneo et al. ..... 206/554 |
| 5,941,392 | A | * | 8/1999 | Huang et al. ..... 206/554 |
| 6,065,233 | A | * | 5/2000 | Rink |
| D433,857 | S | * | 11/2000 | Nguyen |
| 6,142,302 | A | | 11/2000 | Requena |
| 6,264,059 | B1 | * | 7/2001 | Requena ..... 206/554 X |
| 6,505,750 | B1 | * | 1/2003 | Nguyen ..... 211/163 |

* cited by examiner

*Primary Examiner*—Robert W. Gibson, Jr.
(74) *Attorney, Agent, or Firm*—Joseph T. Regard, Ltd.

(57) ABSTRACT

A bag and system for dispensing thermoplastic bags or the like from a stack of bags. The present system is configured for point of use dispensing to a customer, such as in the produce section of a grocery store or market. Each bag pack is dispensed from a station which includes an underlying, medially situated, angled bag pack support, configured to provide optimal support for the user in opening and removing the bag to be dispensed from the bag pack. Further contemplated is a unique cover which is placed over the bag pack to be dispensed, the cover having an opening formed therethrough for the dispensing of bags therethrough, the opening configured to provide optimal dispensing of the bags while maintaining the remaining bags in a uniform bag pack.

12 Claims, 21 Drawing Sheets

FIG. 10A
PRIOR ART
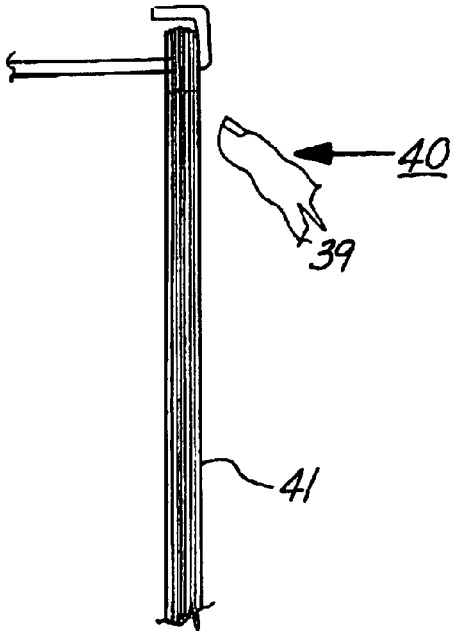
FIG. 10B
PRIOR ART
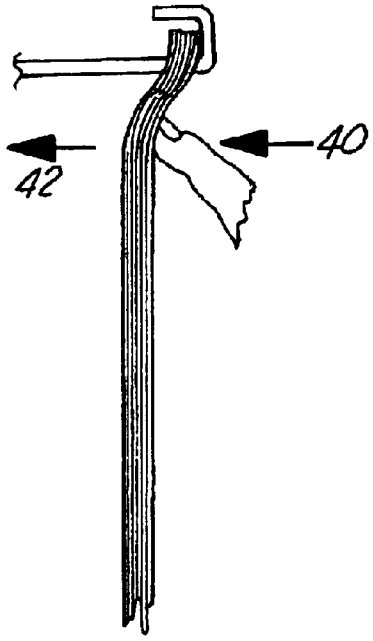
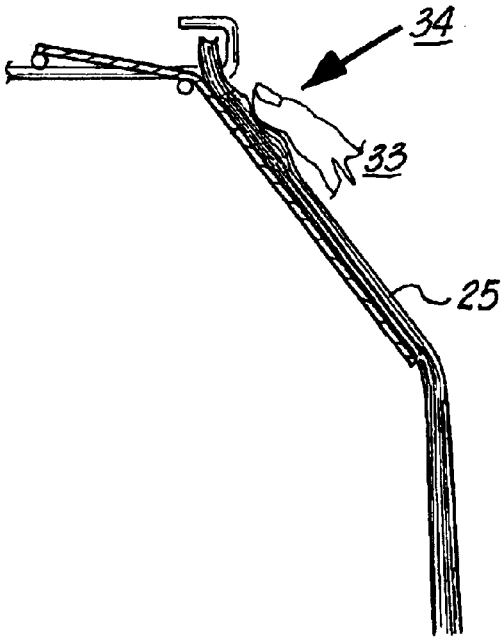
FIG. 10C
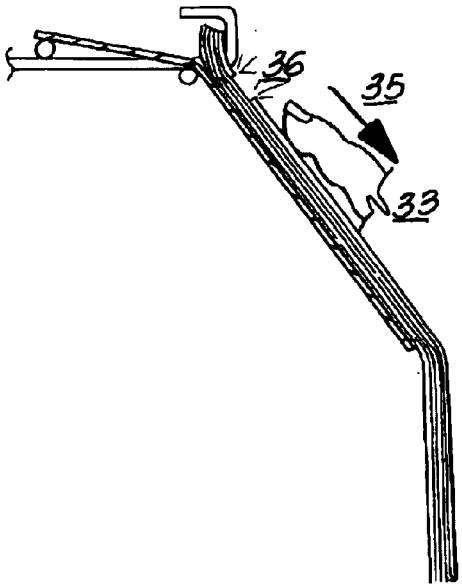
FIG. 10D 46
47
44
44'
47
49
48
43
45
43

43

THERMOPLASTIC BAG DISPENSING SYSTEM

STATEMENT OF CONTINUING APPLICATIONS

This application is a continuation-in-part of U.S. Design Application 29/120,858 filed Mar. 28, 2000 now U.S. Pat. No. Design, 435,379 and U.S. Design Application 29/120,859 now U.S. Pat. No. Design, 433,857 each said application listing Hank Duc Nguyen as inventor, and having the title "Produce Bag Dispensing Rack". This application is also a continuation in part of U.S. Utility application Ser. No. 09/596,768 filed Jun. 19, 2000, now U.S. Pat. No. 6,505,750.

TECHNICAL FIELD OF THE INVENTION

The present invention relates to bag dispensing systems, and particularly to a bag and system for dispensing thermoplastic bags or the like from a stack of bags. The present system is configured for point of use dispensing to a customer, such as in the produce section of a grocery store or market.

The preferred, exemplary embodiment of the present system teaches a free standing bag dispensing stand configured to hold at least a single pack of produce bags, but which may include as many as four or more produce bag packs of equal or different sizes. Each bag pack is dispensed from a station which includes an underlying, angled bag pack support, configured to provide optimal support for the user in opening and removing the bag to be dispensed from the bag pack.

A further component of the present system is a unique cover which is pivotally affixed to the bag rack and rests upon the exposed side of the bag pack to be dispensed, the cover having a base configured to engage the lower portion of the bag pack, and first and second support members formed an open space therebetween for the dispensing of bags therethrough, the opening configured to provide optimal dispensing of the bags while maintaining the remaining bags in a uniform bag pack. The cover may include at its base advertising, and to this end may include a pocket or retaining means for allowing the placement of notices, advertising thereupon, or holding means for allowing the dispensing of coupons or bag ties therefrom. The cover not only facilitates uniform dispensing of bags from the pack, but also holds the pack down when the system is used in windy conditions.

BACKGROUND OF THE INVENTION

Produce bags are dispensed directly to customers at produce counters or the like, where the customer can bag the produce as it is chosen for purchase. A common problem with dispensing produce bags is providing the bag to the consumer in a convenient, simple, and reliable fashion. Further considerations relate to ease of replenishing the supply, uniformity of dispensing, ease of opening, and providing closure means such as bag ties or the like. Prior art patents have contemplated various dispensers for produce bags, including rolls of unfolded or folded bags, dispensing boxes, and stands, which may be wall mounted for free standing.

U.S. Pat. No. 5,732,833 issued 1998 teaches a free standing plastic bag dispenser for dispensing packs of produce bags or the like, wherein the bag packs are hung on folded plastic tab members and supported by a single, wide, medially situated hook (18A). A horizontally situated backing bar (16) for maintaining the packs "in a substantially planar condition which is pleasing to the eye". FIG. 8 illustrates a bag pack having a perforated tab which is heat sealed at insertion points (22*e*), the tab having formed therein first and second apertures (27) for receiving first and second support hooks (18').

While the prior art has contemplated a free standing produce bag stand for dispensing individual bags from a pack of produce bags, it would appear that the prior art has failed to teach a produce bag dispensing system which includes an angled medial support member to aid in removing the top most bag from the stack.

GENERAL SUMMARY DISCUSSION OF THE INVENTION

Unlike the prior art, the present invention provides a bag dispenser system which is comparatively strong and reliable, while being inexpensive to manufacture, requiring little in the way of custom manufacturing equipment, while being consistent in performance and quality.

Prior art systems for produce bag dispensers for dispensing individual bags from a pack of bags are found to have shortcomings relating to the expense of manufacture and the ease of use. Specialized tabs for supporting the bag packs add material and labor costs to the product, as well as requiring specialized racks for holding the packs. Hanging the bag pack presents additional problems in dispensing the top most bag, as the hanging pack lacks support, and a user pressing against the top most bag in an attempt to retrieve same must pinch and grab the bag to pull it, as applying pressure to the bag simply results in the bag pack being pushed back. When the user must pinch and grab the bag, all to often more than one bag at a time is dispensed, and the additional bags often end up on the floor, resulting in waste and a potential safety hazard.

What is therefore required is a bag rack which is provides a stable platform for the dispensing of produce bags, so that a user may easily and with little instruction dispense a single, top bag from the pack.

The present invention provides the stability lacking in the prior art by adding an angled support member situated below the upper portion of the bag packs, the support member providing a stable platform upon which a user may apply pressure to the top bag of the pack, and pulling toward the user, the bag is dispensed without the necessity of pinching the bag pack and pulling the pack toward the user, which, as above disclosed, can result in more than one bag being dispensed.

In order to further aid dispensing of the top most bag from the bag pack, a cover having some mass is provided to provide a weighted top layer over the bag pack, the cover forming a dispensing area which guides the user to the optimal portion of the bag for dispensing same, wherein the user contacts the top most bag within the confines of the aperture formed in the cover, and, by pressing down upon the top most bag and directing said pressure toward the consumer, the bag pack is supported by the underlying support member, and the top most bag is detached from the pack and dispensed through the aperture to the customer consistently as a single bag with relative reliability and ease. The cover has the additional purpose of providing pressure upon the side edges and bottom of the bag pack, which in cooperation with the upper portion which engages the rack, stabilizes the bag stack on the rack to prevent the bag pack from blowing in wind, while securing the bag pack in a flat, uniform fashion. The downward pressure of the cover further facilitates the dispensing of a single bag from the bag stack at a time, preventing waste.

It is therefore an object of the present invention to provide an improved system for dispensing individual thermoplastic bags or the like.

It is another object of the present invention to provide a perforated, solid fused tab having a first and second handle support apertures or slits formed therein for accepting first and second support hooks or support members on the rack.

It is still another object of the present invention to provide a bag dispensing system which requires little significant equipment modification, while providing a consistent quality, strong and aesthetically acceptable product.

It is another object of the present invention to provide a bag rack which includes a medial support member for providing angled support of the dispensing area of the pack.

It is another object of the present invention to provide a cover configured to be used with the bag pack and rack of the present invention, wherein the support cover has formed therethrough a dispensing aperture configured to guide the user to the optimal portion of the top bag for dispensing from the bag rack.

It is still another object of the present invention to provide a cover which protects the bag pack while maintaining the bag pack in a flat, uniform, fashion even under windy conditions.

Lastly, it is an object of the present invention to provide a bag pack which is easily loaded upon a rack, providing a consistent and reliable dispenser for produce bags or the like.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIGS. 10A–10B illustrate prior art designs of a bag rack, and the removal of a bag therefrom.

FIGS. 10C–10D illustrate removal of the bag pack from the present invention of FIG. 9.

DETAILED DISCUSSION OF THE INVENTION

Figure 1:
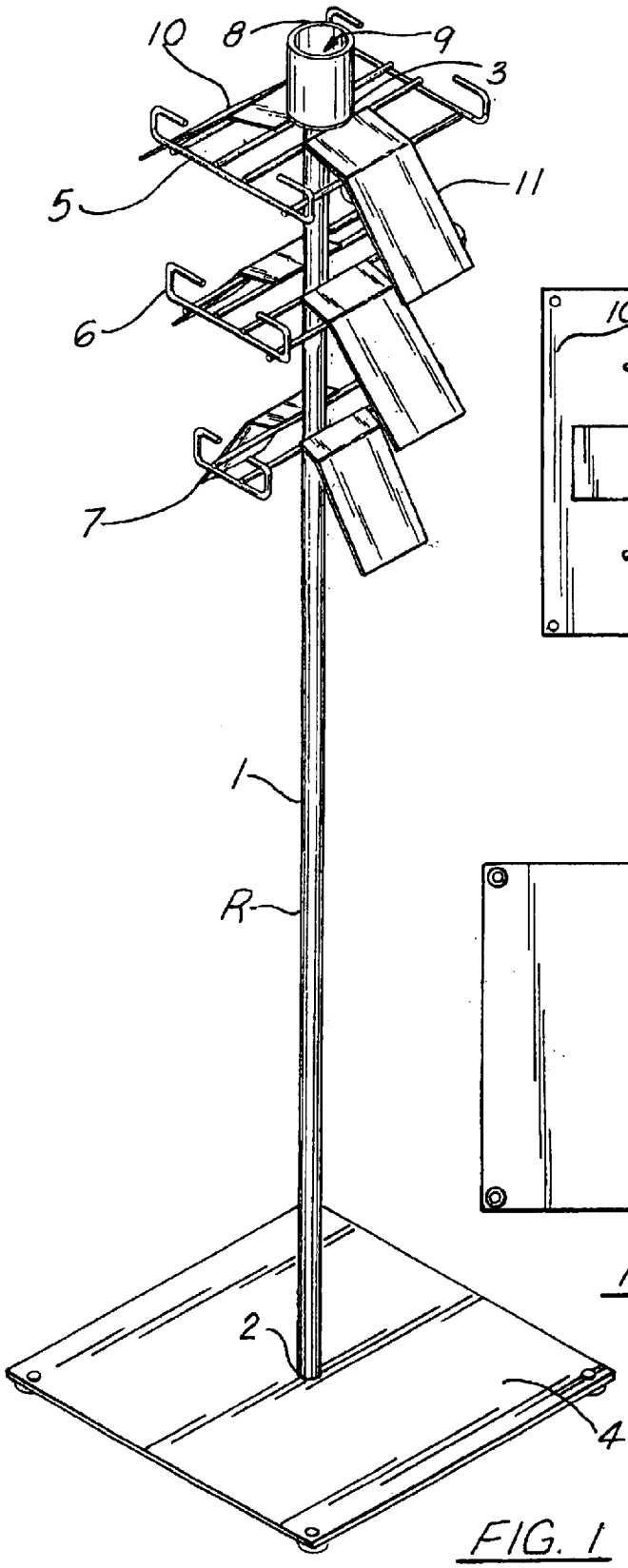
FIG. 1 is an isometric, side view of the first embodiment of the rack of the present invention.
Figure 2:
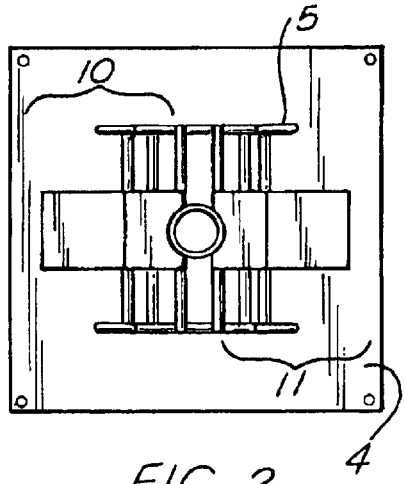
FIG. 2 is a top view of the rack of FIG. 1.
Figure 3:
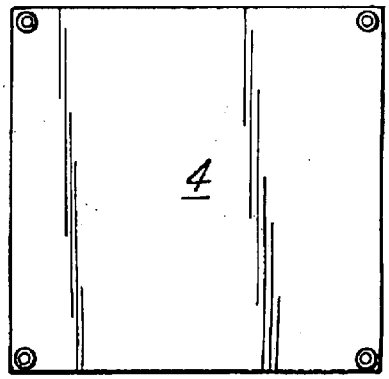
FIG. 3 is a bottom view of the rack of FIG. 1.
Figure 4:
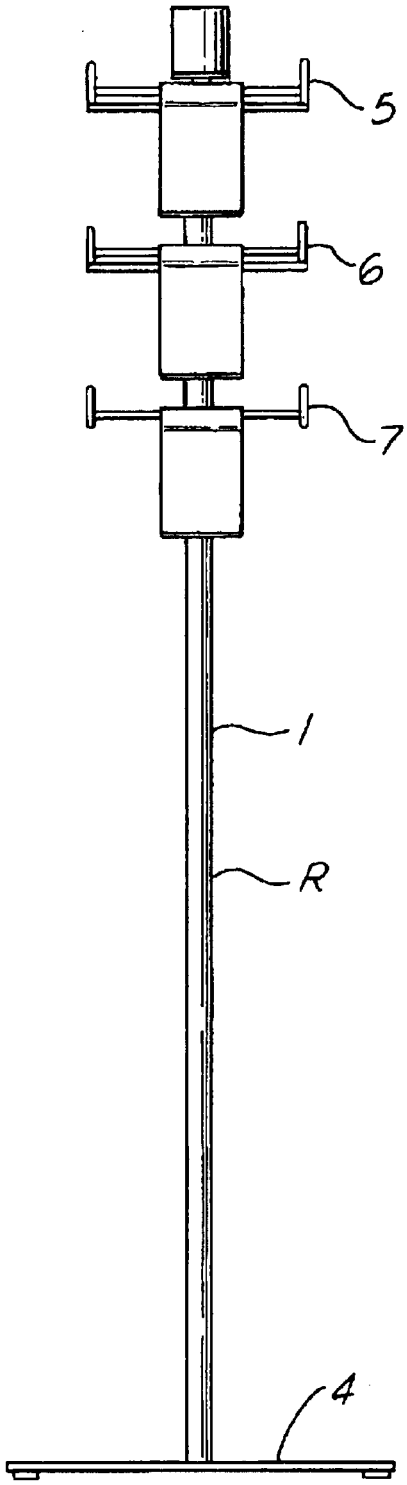
FIG. 4 is a side view of the rack of FIG. 1
Figure 5:
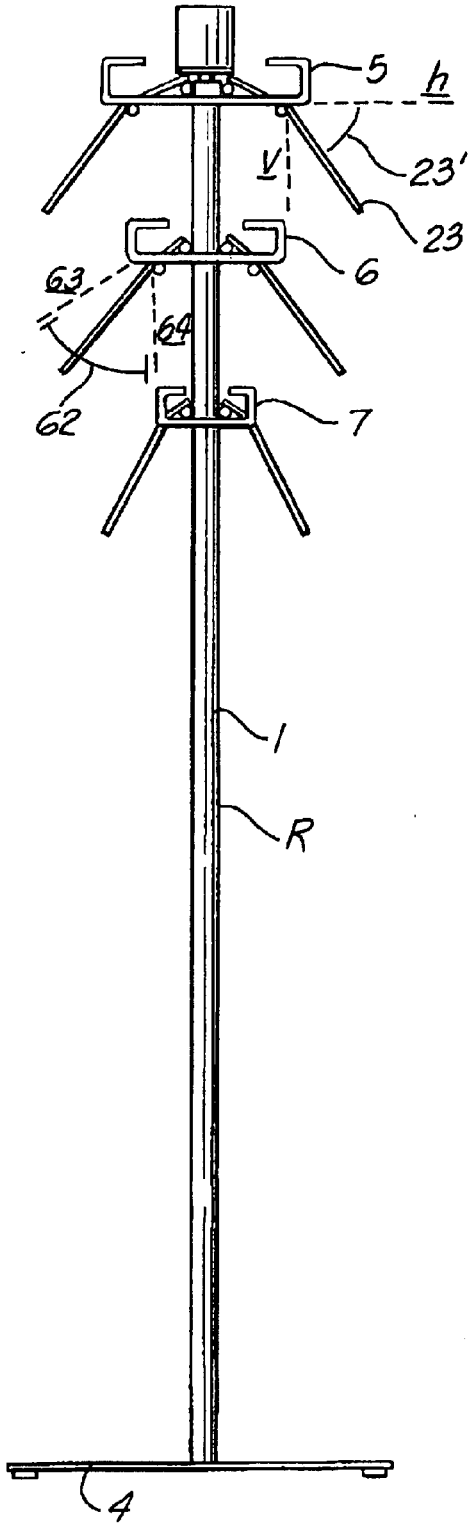
FIG. 5 is an end view of the rack of FIG. 1.
Figure 6:
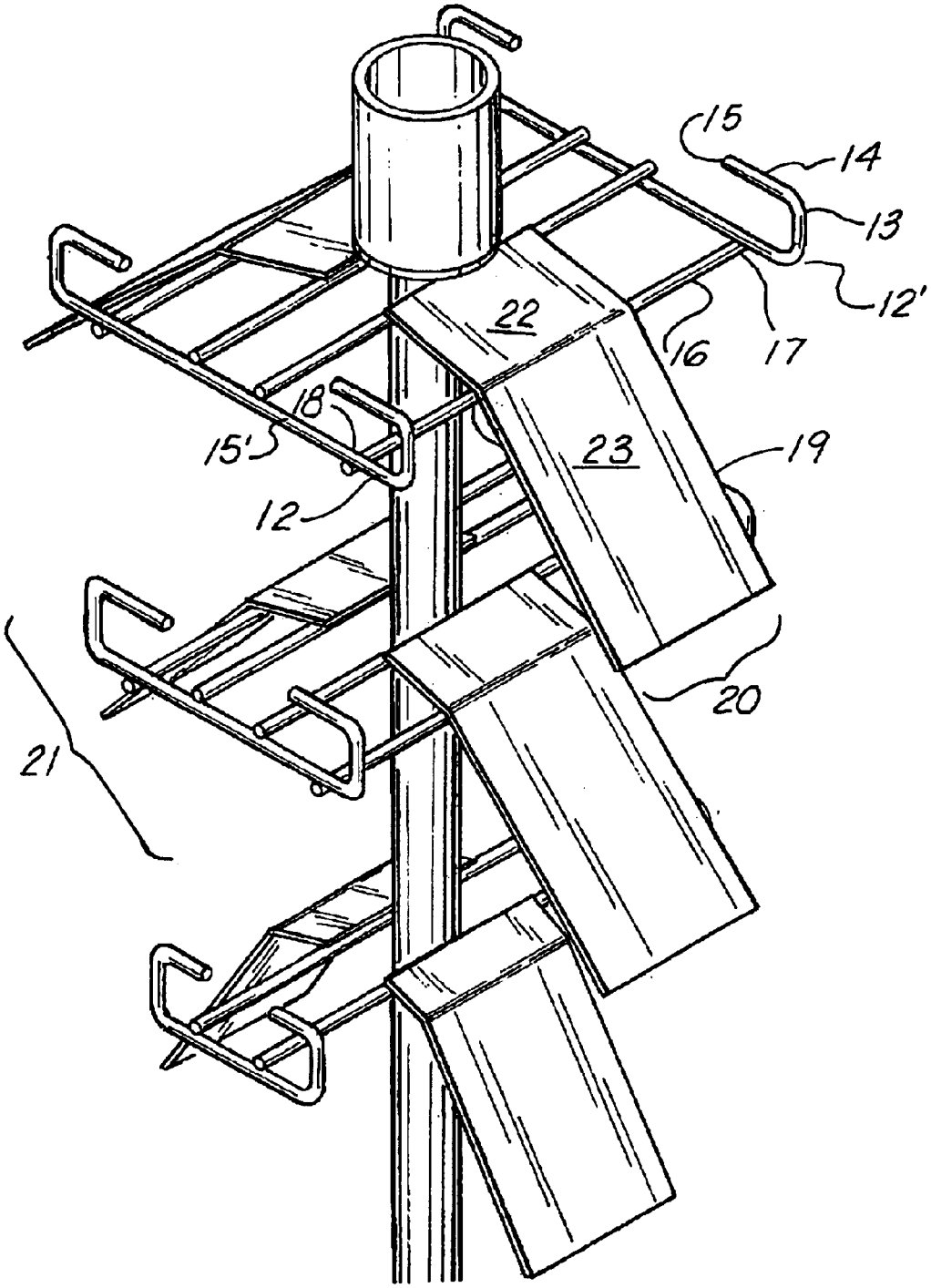
FIG. 6 is an isometric view of the upper portion of the rack of FIG. 1.

As can be seen in FIGS. 1–9, the first embodiment of the rack R of the present invention includes a vertical support member 1 having first 2 and second 3 ends, the first end 2 engaging a base 4, the second end 3 supporting a top rack 5, medial rack 6, and lower rack 7. Situated upon the top rack 5 is a tie dispenser 8 which includes a receptacle 9 for the placement of bag ties or the like therein.

Each rack 5, 6, or 7 includes first 10 and second 11, opposing dispenser stations situated on a common horizontal plane, each dispenser station having a base formed of wire and supporting first 12 and second 12' support hooks, each of the hooks including a generally vertical portion 13 communicating with an upper, rearwardly directed hook member 14. Situated between the first and second dispenser stations are horizontal support rods 15, 15', the first 12 and second 12' support hooks having situated therebetween a medial support bar 16 having first 17 and second 18 ends communicating with said horizontal support rods 15', 15, respectively.

Supported by said medial support bar 16, between said first 12 and second 12' support hooks is a medial planar support member 19 having a width 20 and a length 21, an upper horizontal area 22 and a declining, planar support area 23 or piece emanating from the medial support bar 16. As shown, the declining planar support area 23 may have an angle 23' of, for example, forty-five degrees relative to the horizontal H or vertical V, although operational ranges 62 of declination of the planar support area may range widely, for example about five degrees 63 to about ninety degrees 64, relative to the horizontal. Further, the width of the declining planar support area 23 may vary depending upon the application and size bag to be dispensed, although the width should be sufficient to enable a user to easily utilize same to support the bag pack during dispensing of the top bag, as will be more fully discussed infra; an exemplary width of the declining support area may be, for example, about four inches.

The present system further includes a bag pack 24 comprising a stack of bags including a top bag 25, each bag having a uniform width and length 26. The bags are retained in a pack via a heat fused tab portion 27 removably connected to the upper edge forming the mouth of the bag, via perforated line 28, the tab portion further having second and first support apertures 30', 30 or slits formed therethrough, configured to engage first and second hooks 12, 12', respectively.

Figure 7:
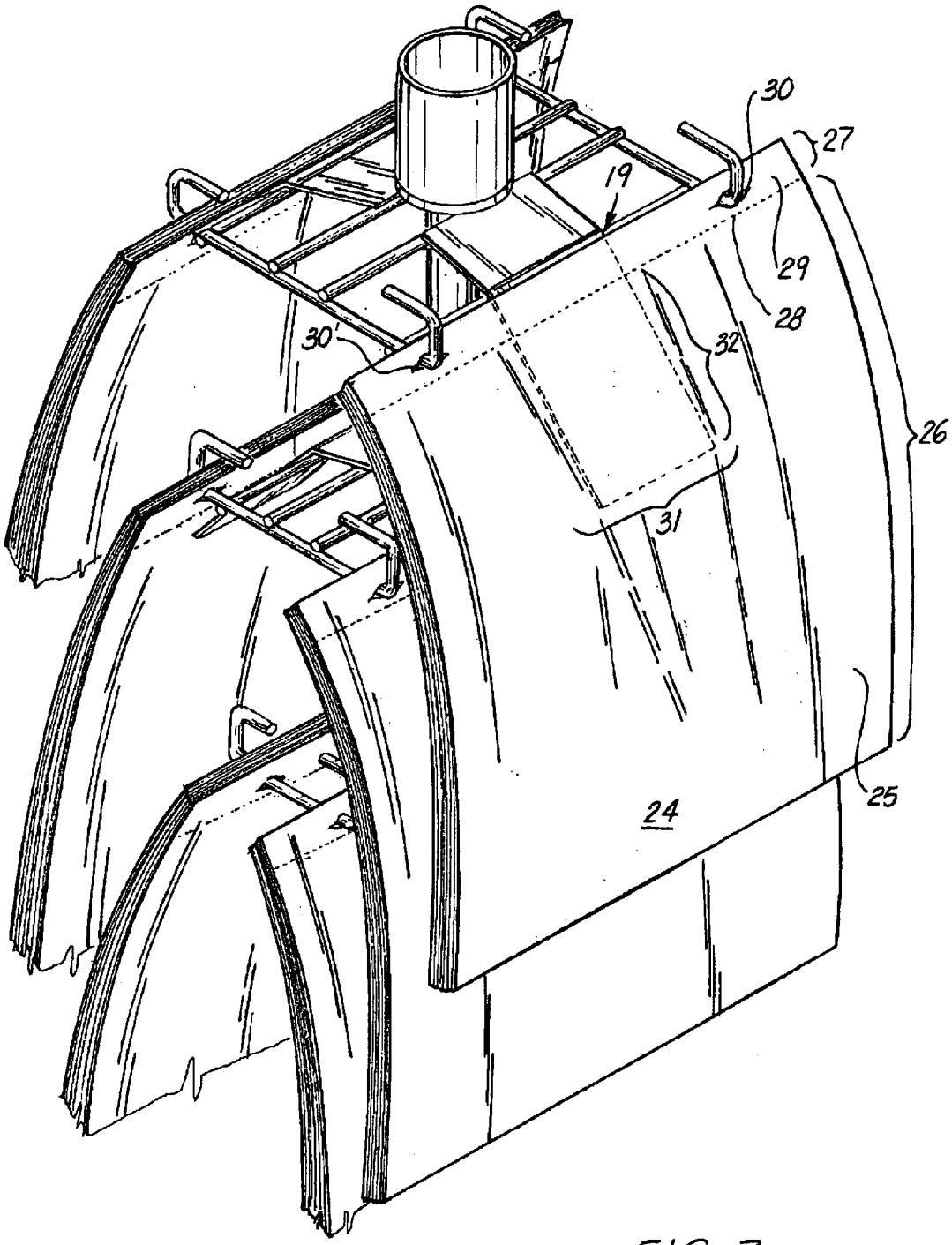
FIG. 7 is an isometric view of the rack of FIG. 1 having bag packs loaded thereupon.
Figure 8:
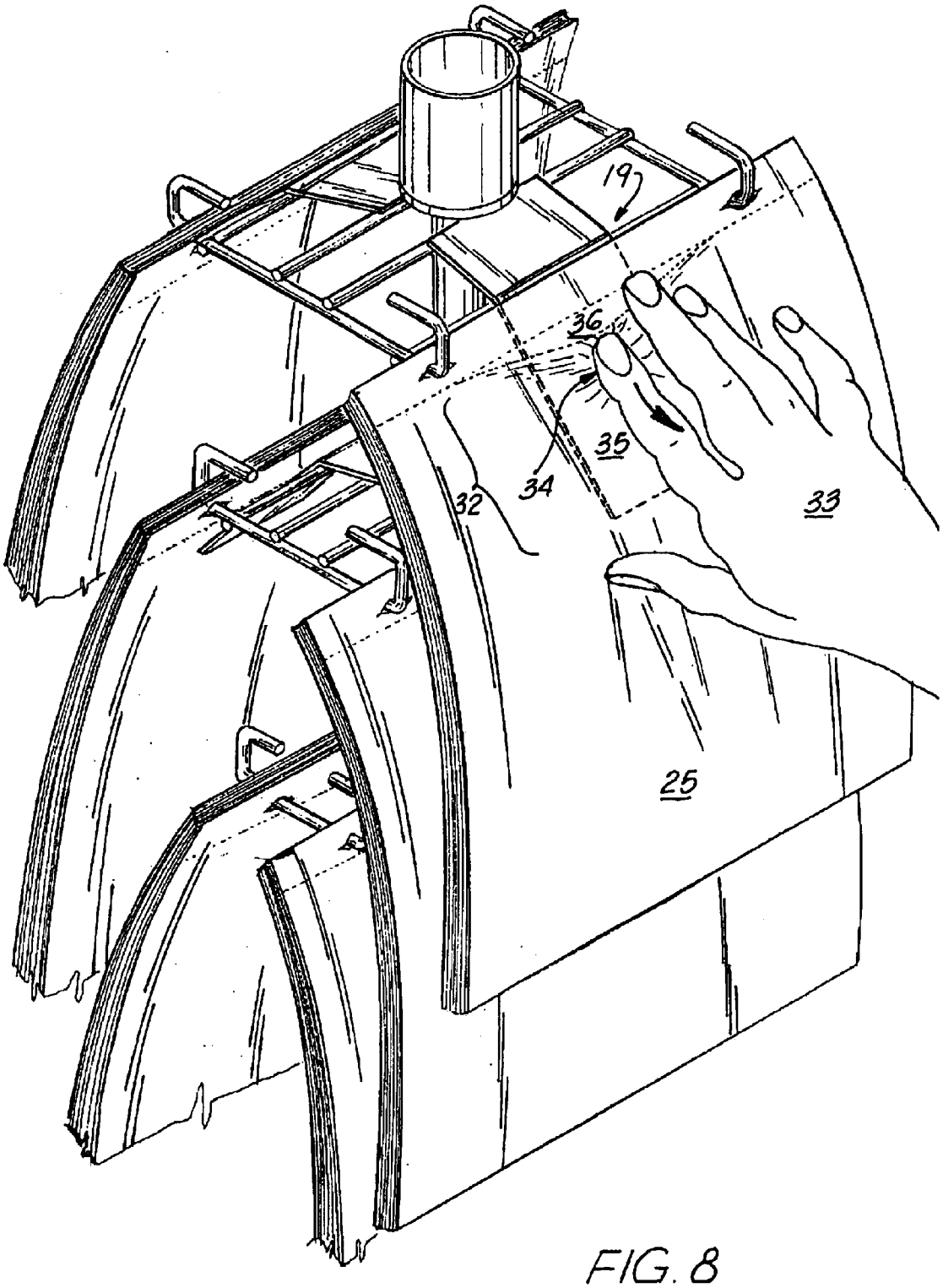
FIG. 8 is an isometric view of the rack of FIG. 7, illustrating the dispensing of a top bag from one of the bag packs.
Figure 9:
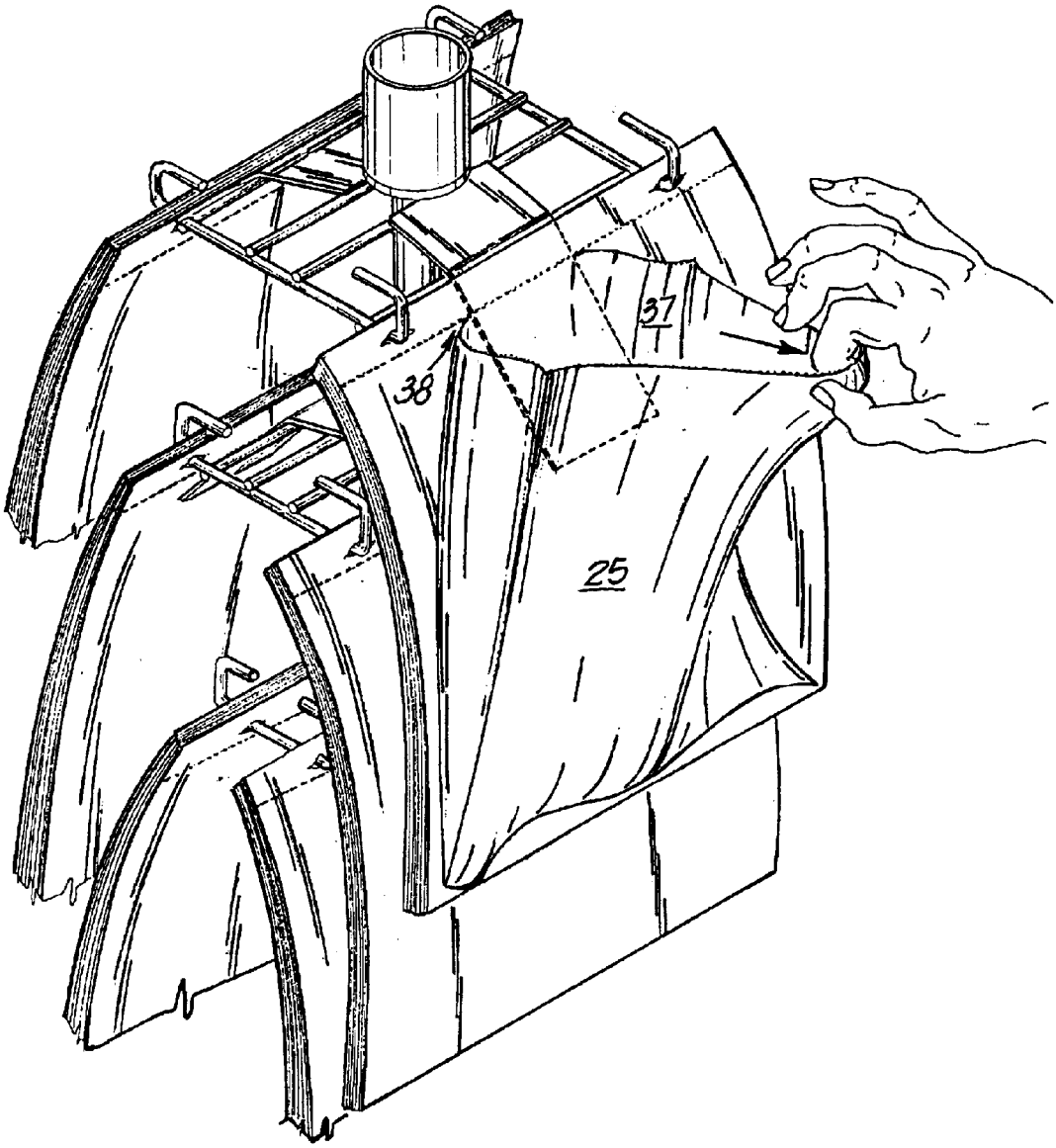
FIG. 9 is an isometric view of the rack of FIG. 8, illustrating the removal of a top bag from the bag pack.

Continuing with FIGS. 7–9, the upper medial area 31 of the bag pack 24 is supported in declining angled fashion via the declining planer support area of the medial planer support member 19, providing a supported dispensing area 32 on the bag pack for enhanced dispensing of individual bags from the bag stack by a user.

In use, the user 33 applies pressure 34 to the top bag within the supported dispensing area 32 over the planer support, so that the underlying declining planer support area of the medial planer support member 19 supports the medial area 31 and supported dispensing area 32 of the bag and bag pack, allowing the user to pull 35 the top wall of the bag toward the user, separating 36 the perforated portions, opening bag 37, and removing and dispensing 38 same from the pack. This supported dispensing via the support member 29 offers advantages over prior art systems, shown in FIGS. 10A and 10B, which did not provide the underlying support of the present invention. As shown, when a user 39 applied pressure 40 to a prior art bag pack 41, the pack, not being supported in an underlying fashion, would likewise move back 42, and the user would be left with attempting to separate the top wall of the bag from the pack, and pinching and pulling same to remove the top bag form the pack, a process which could prove frustrating and could result in multiple bags being inadvertently removed from the pack at one time. Often the extra dispensed bags would be left to fall upon the floor, where they could pose a slip hazard, or simply be wasted as not being used.

Figures 11A, 11B, 11C:
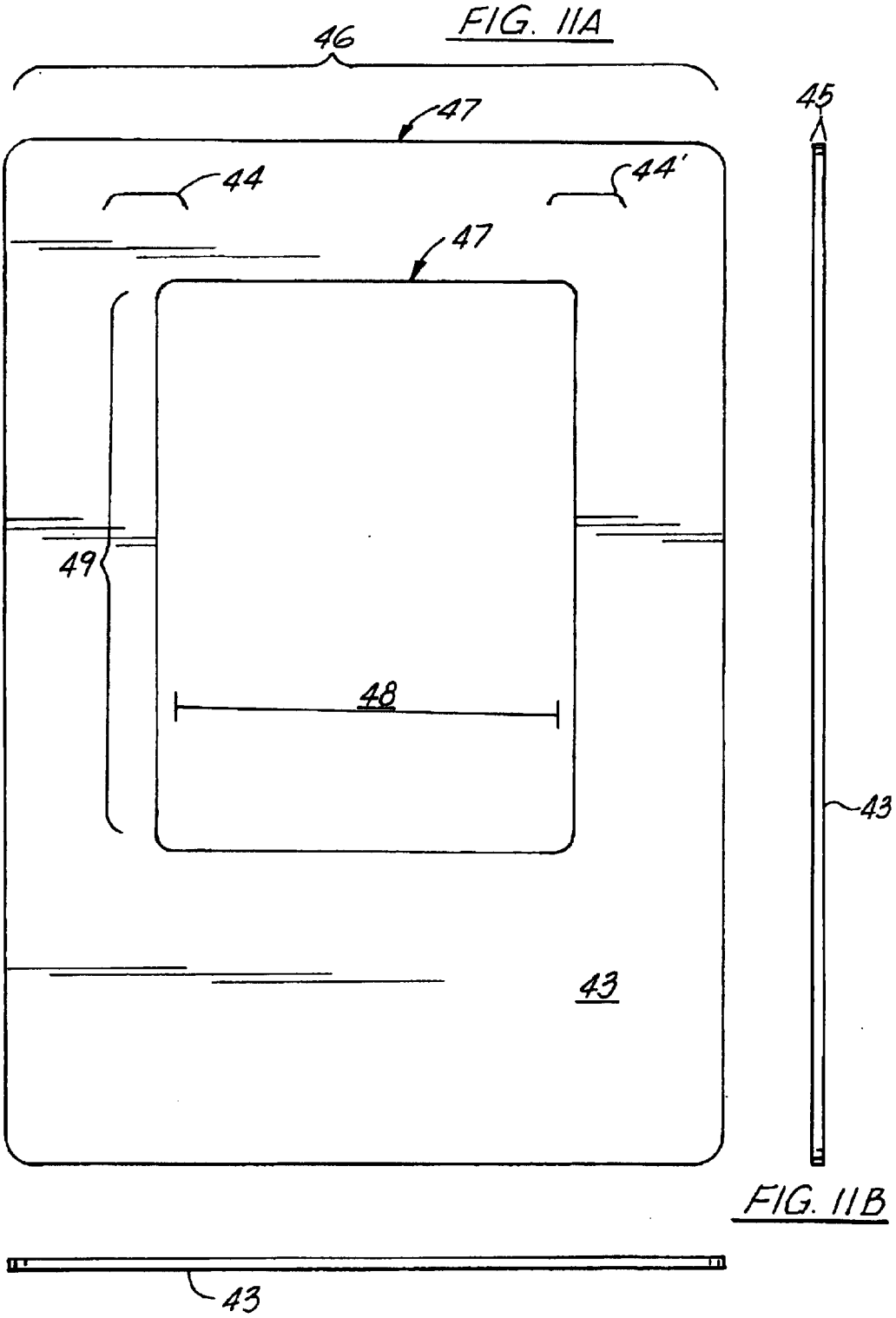
FIGS. 11A–11C illustrate frontal, side, and end views, respectively, of a cover configured to be used with the system of FIG. 9.

FIGS. 11A–11C illustrate a cover which may be used to further enhance dispensing of individual bags from a bag pack utilizing the present system, wherein the cover 43, which may be formed a flexible material, such as, for example, polyethylene, polyurethane, or the like, has ideally a width 46 and length generally commensurate to that of the underlying bag pack, as well as a thickness 45 to provide some mass to the cover to retain it atop the bag pack. The cover may include a material or additive which urges the thermoplastic forming the bags in the bag pack to cling via electrostatic charge to the cover, for enhanced releasable bonding of the cover to the bag pack.

The cover has formed therein a dispensing aperture 47 having a width 48 and a height 49, which may be commensurate with the measurements of the declining planer support area of the bag rack, the cover having first 44 and second 44' support apertures configured to engage the first and second support hooks of the rack.

Figure 12A:
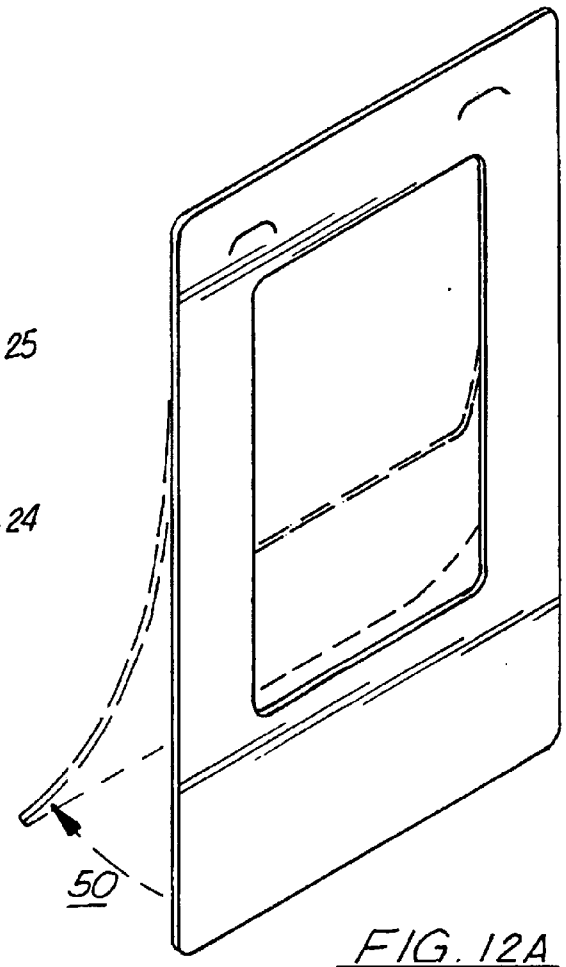
FIGS. 12A–12B illustrate isometric and installed views of the cover of FIGS. 11A–11C, installed upon a rack for dispensing.
Figure 12B:
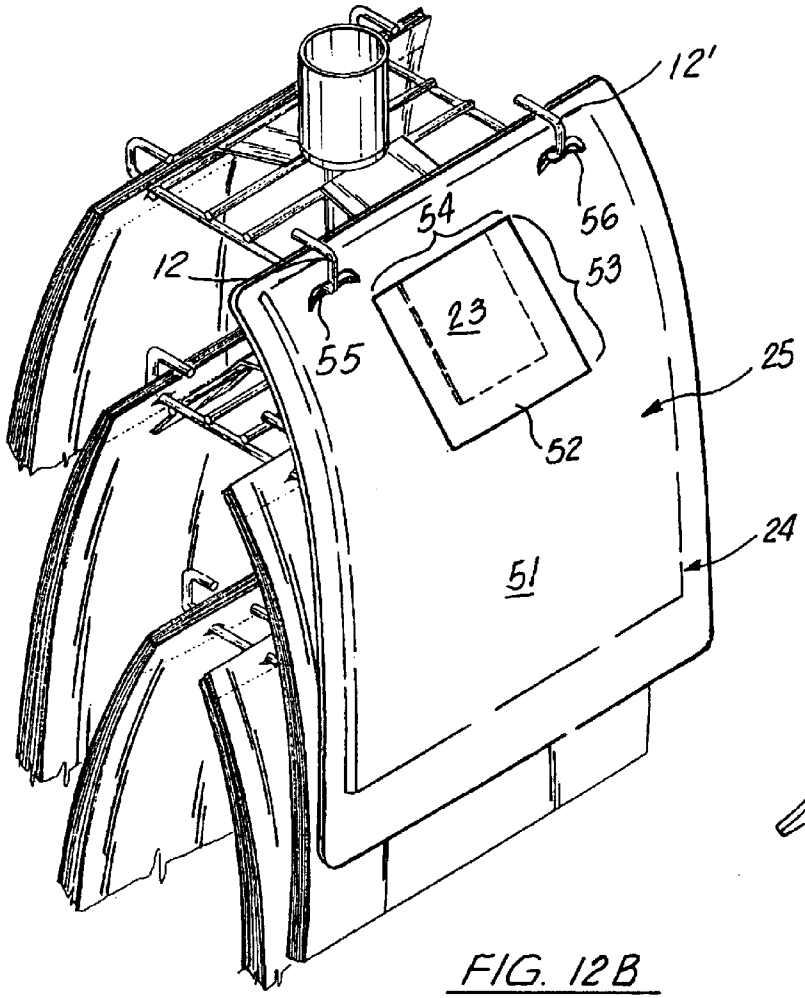
Figure 13B:
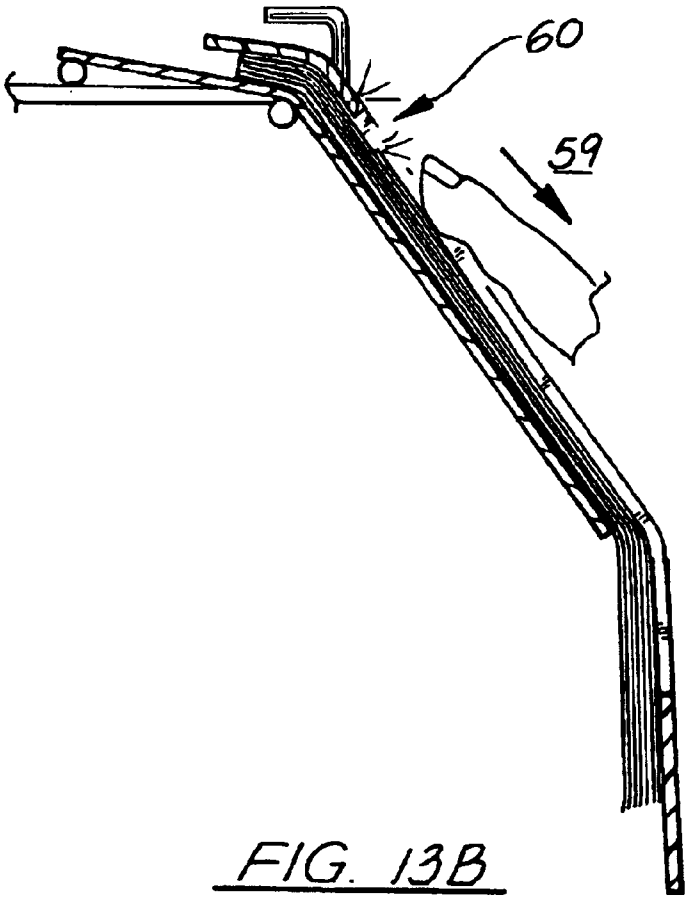
FIGS. 13A–13D illustrate sequential side views of the dispensing of a top bag from the bag pack utilizing the rack, bag pack, and cover of FIG. 12B.
Figure 13A:
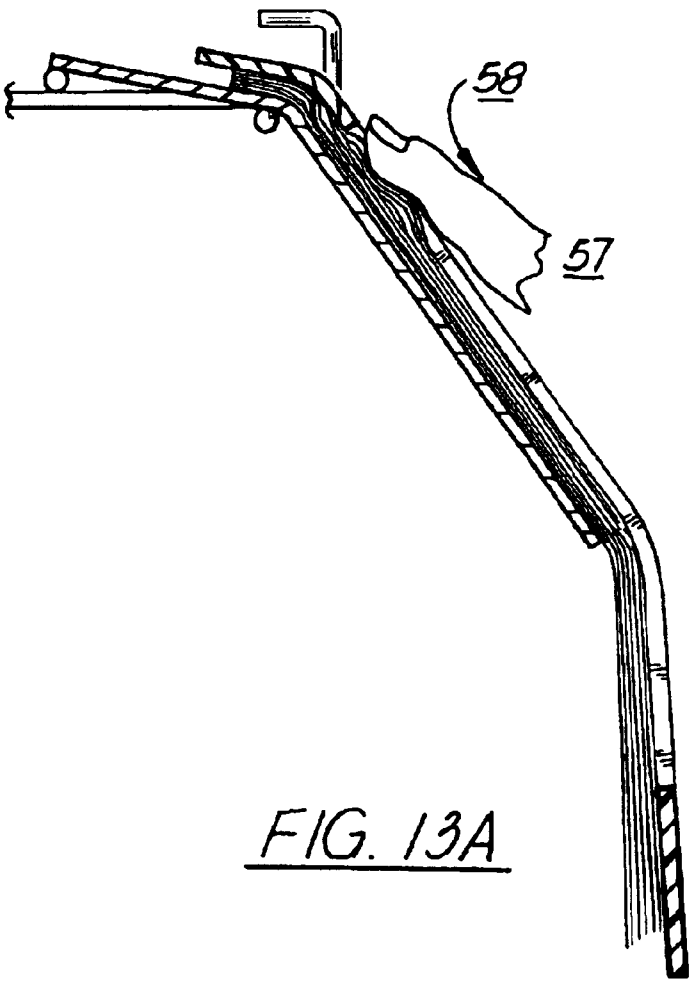
Figure 13C:
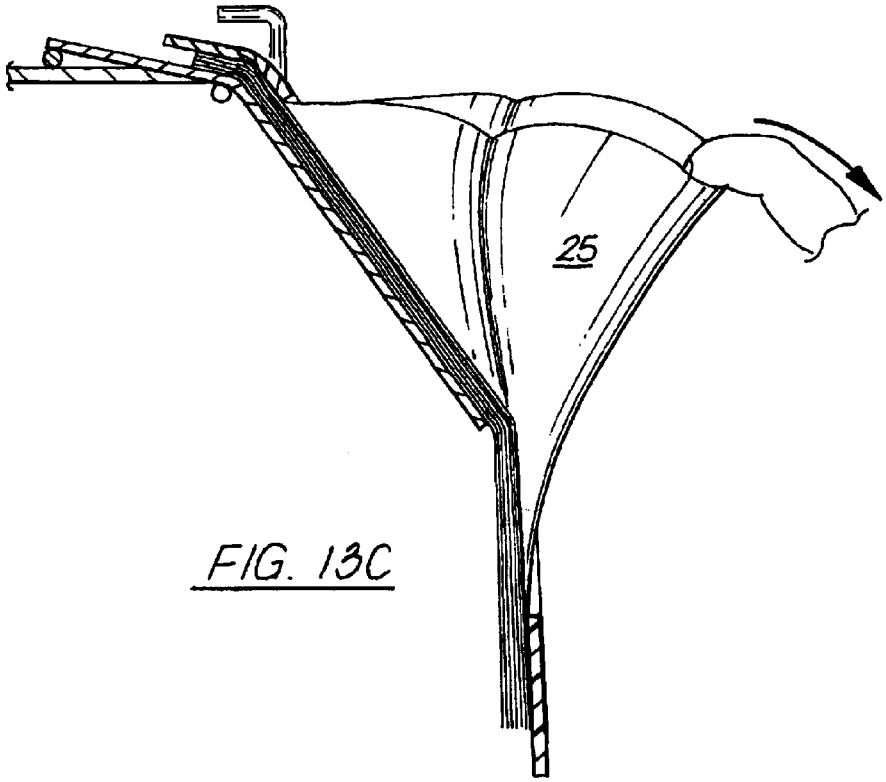
Figure 13D:
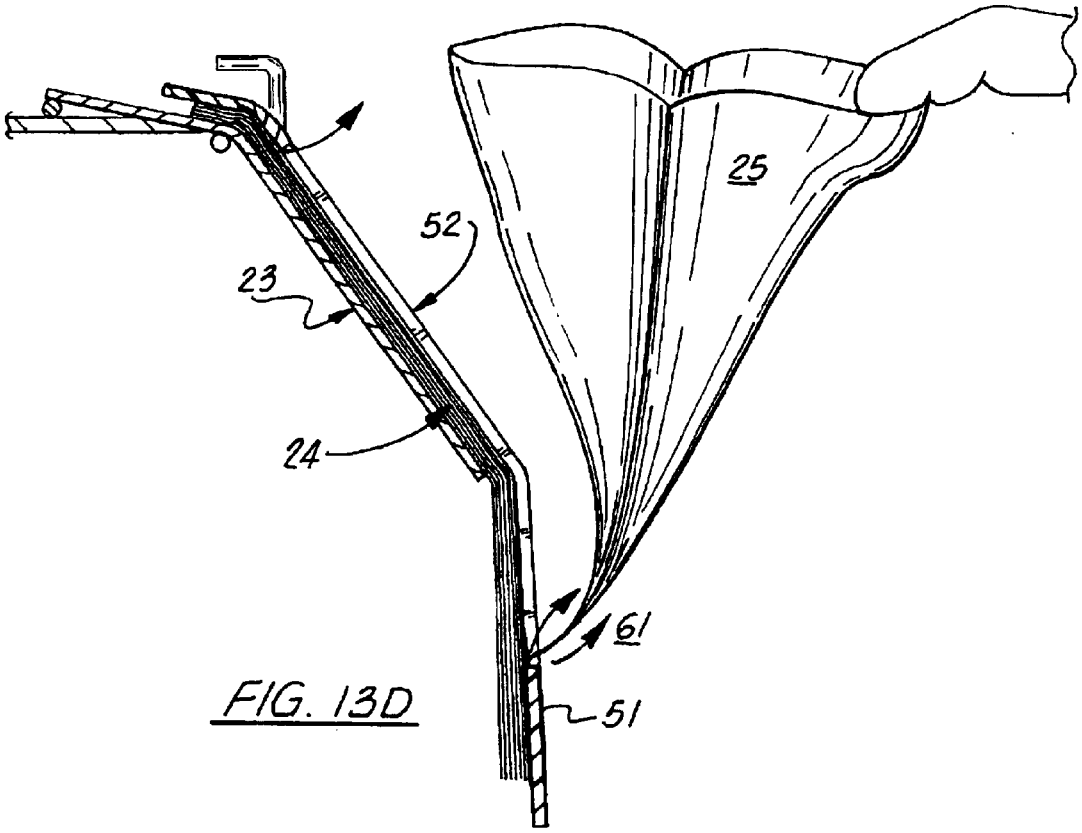
Figure 14A:
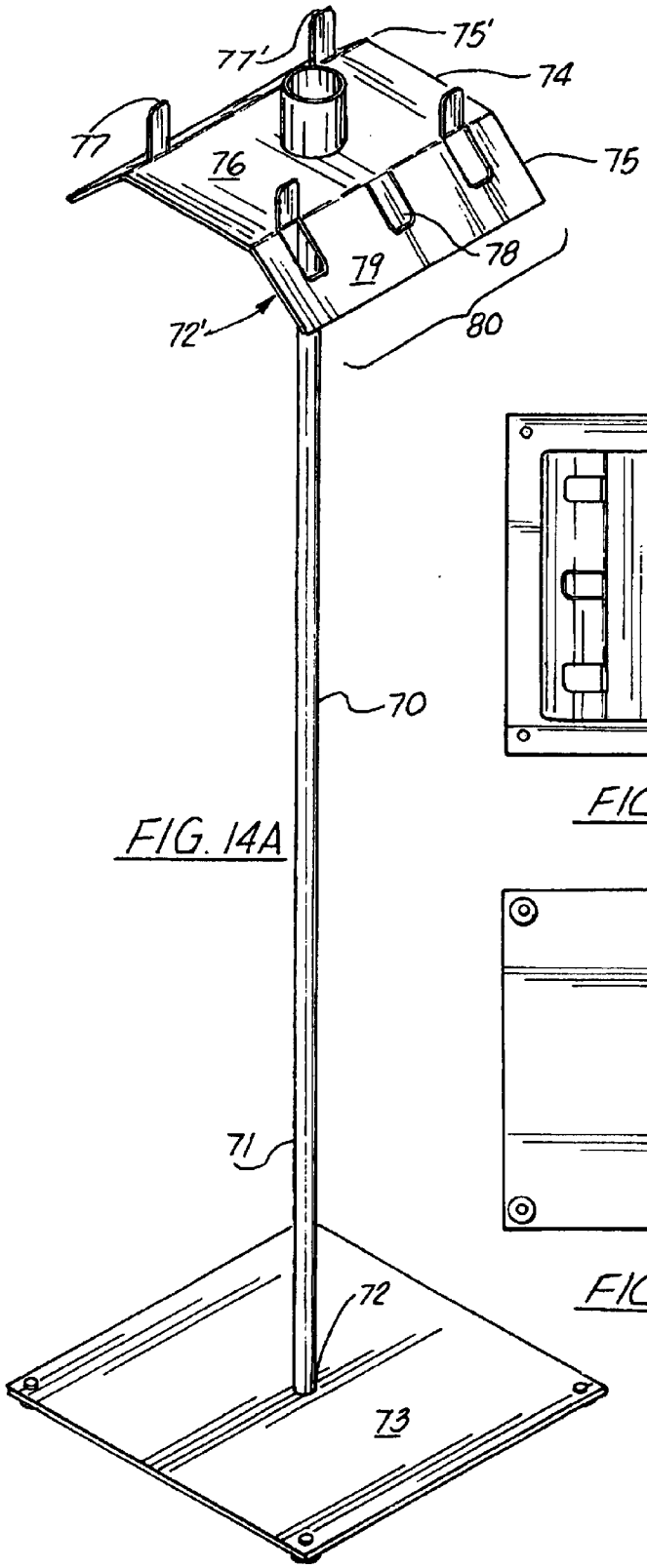
FIGS. 14A–14E illustrate isometric, top, bottom, side, and end views of an alternative embodiment of a rack to the invention of FIG. 1.
Figure 14B:
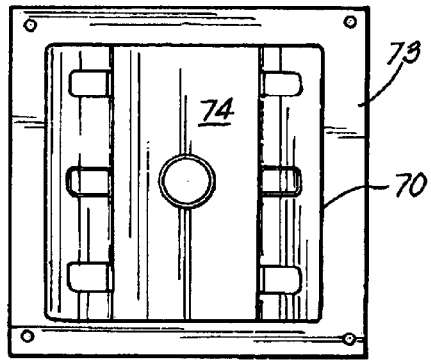
Figure 14C:
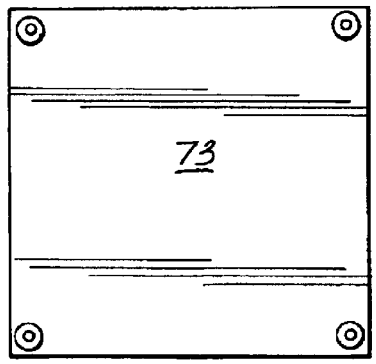
Figure 14D:
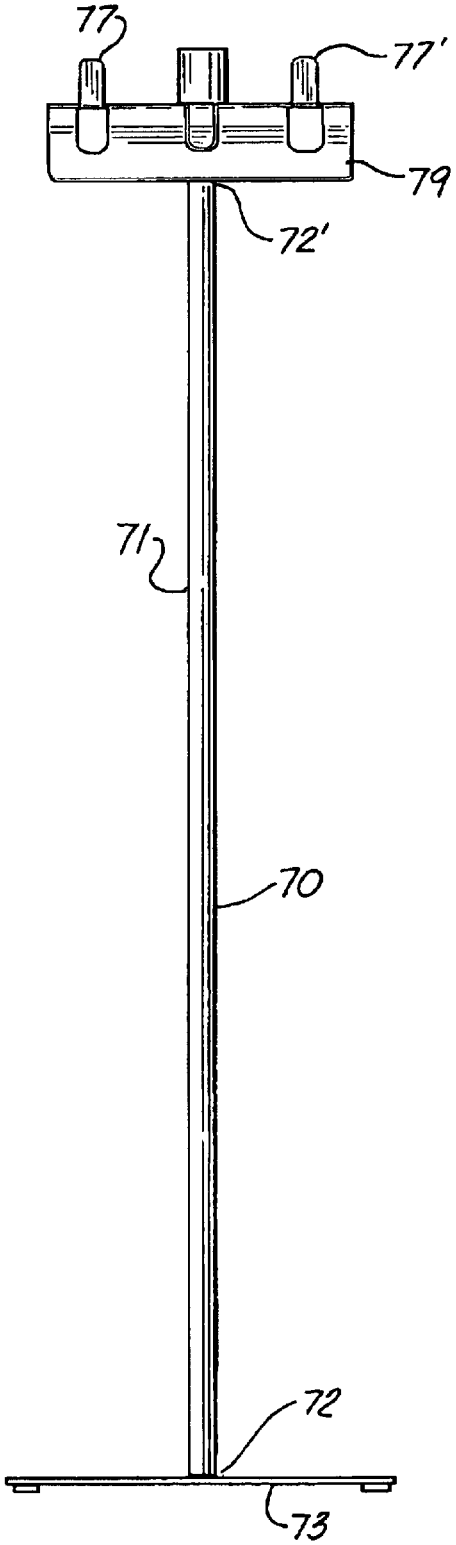
Figure 14E:
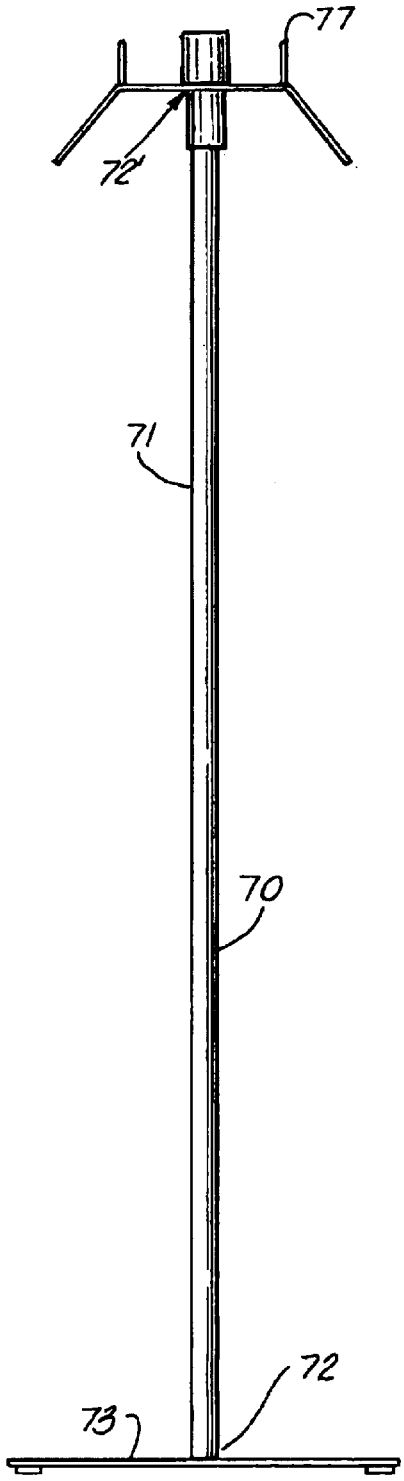

Continuing with FIGS. 12A and 12B, the cover 51 rests upon the bag pack, engaged to the rack via support apertures 55, 56 engaging support hooks 12, 12', respectively, and the dispensing aperture 52 is situated above the declining planer support area 23 of the medial planer support, centered generally medially in the upper area of the bag pack 24 and top bag 25. As indicated, ideally, the dispensing aperture 52 should ideally have a length 53 and width 54 commensurate with the size of the declining planer support area 23, so that a user, when seeking to dispense a bag, must contact the bag via the dispensing aperture, and thereby receive underlying support from the declining planer support area 23. As shown, the cover should ideally be flexible 50 so that it conforms to the shape of the bag pack on the rack.

Figure 16B:
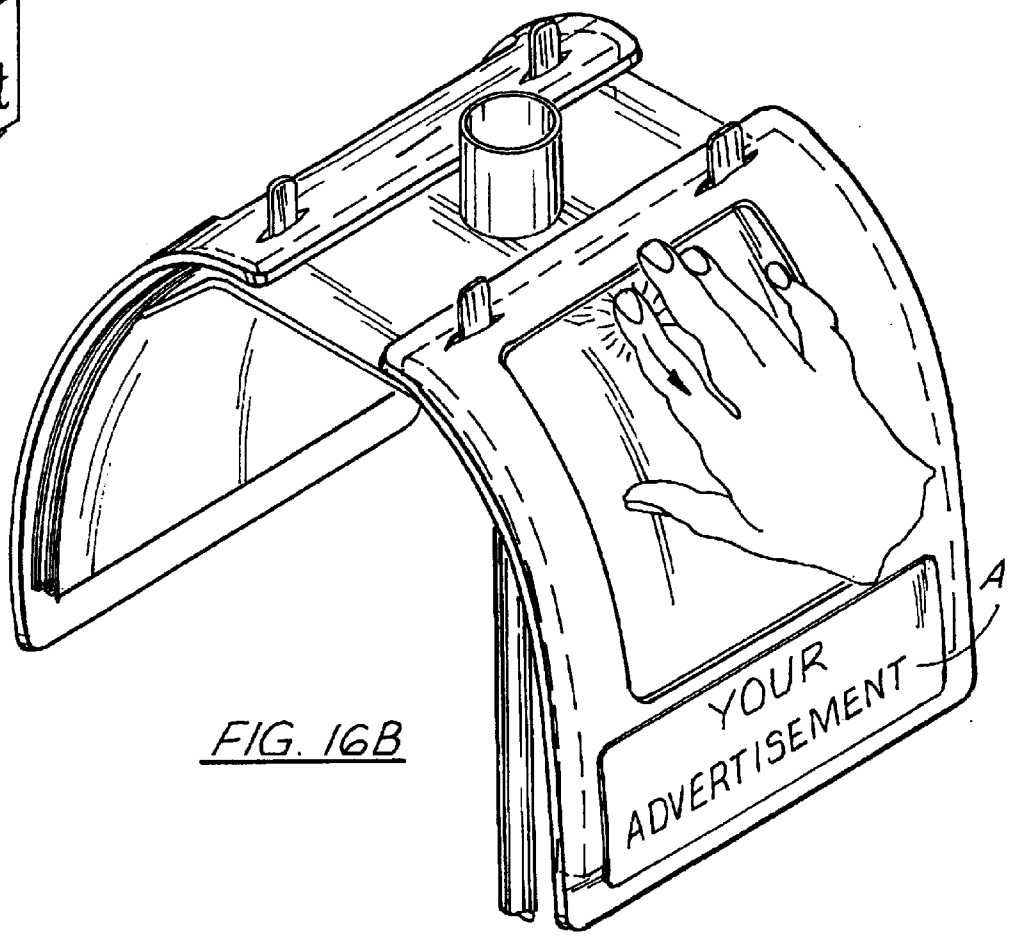
FIGS. 16A–16B illustrate isometric views of alternative cover designs to the system of of FIGS. 11A–11C.
Figure 16A:
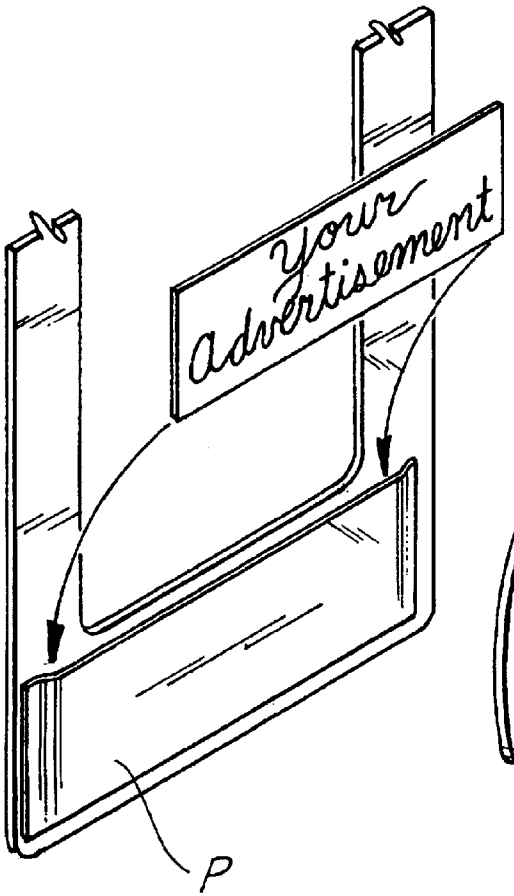
Figure 17B:
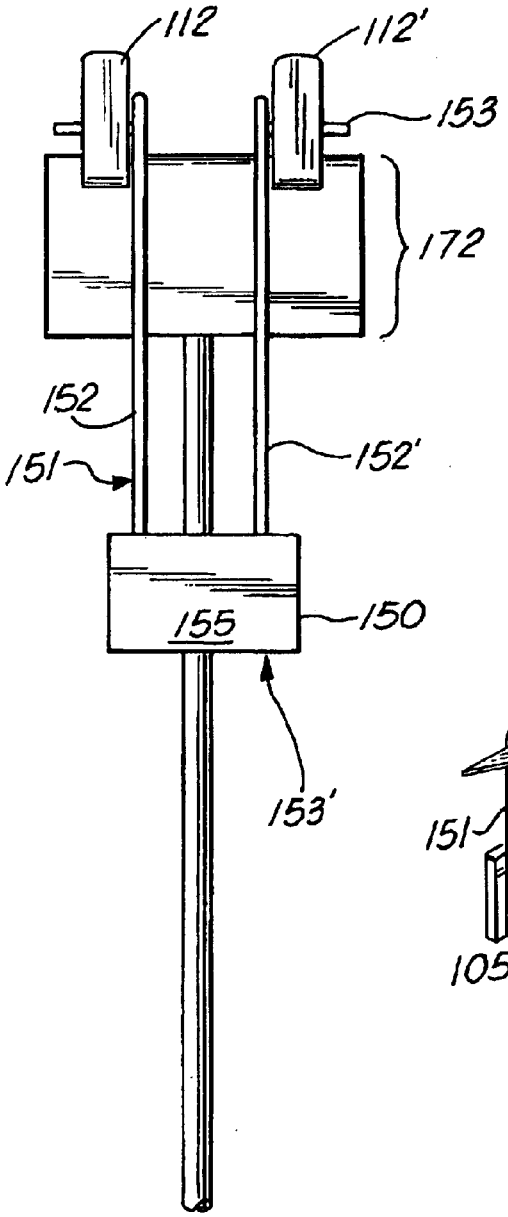
FIG. 17B is an end view of the bag rack of FIG. 17A.
Figure 17A:
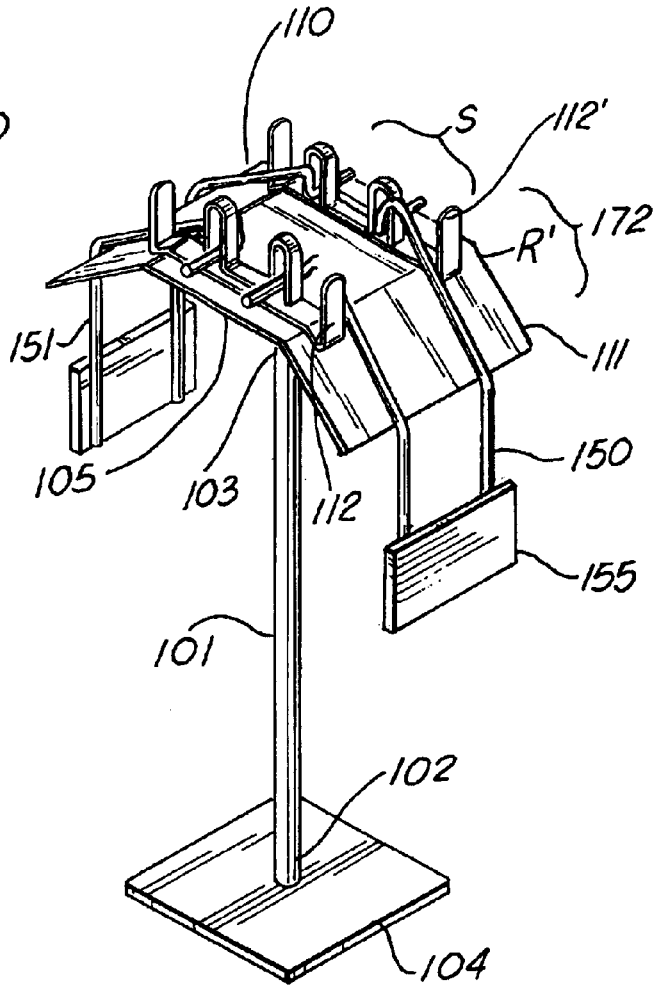
FIG. 17A illustrates an isometric view of a third embodiment of the present invention, illustrating a rack having first and second bag pack holding sections, each said section having a bag pack cover comprising first and second rods pivotally connected to the bag rack at one end, and a lower cover plate at the second end, with a dispensing area defined between the first and second rods.
Figure 17C:
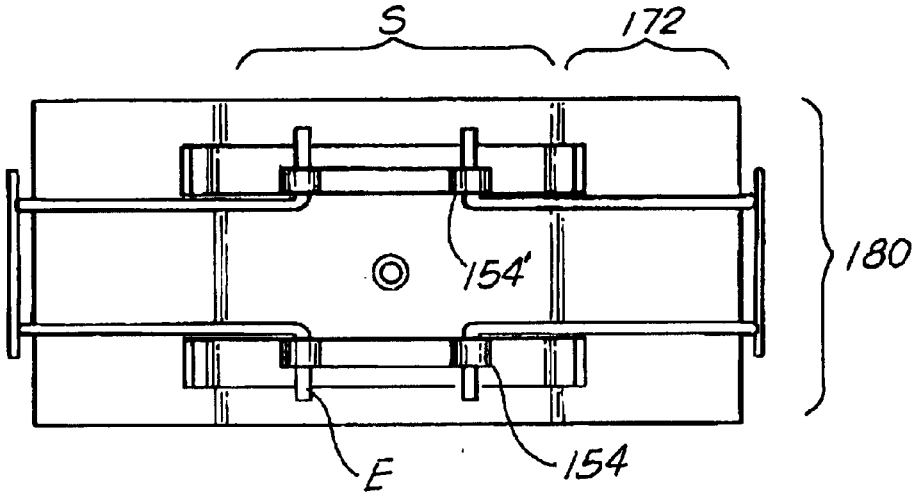
FIG. 17C is a top view of the bag rack of FIG. 17A.
Figure 17D:
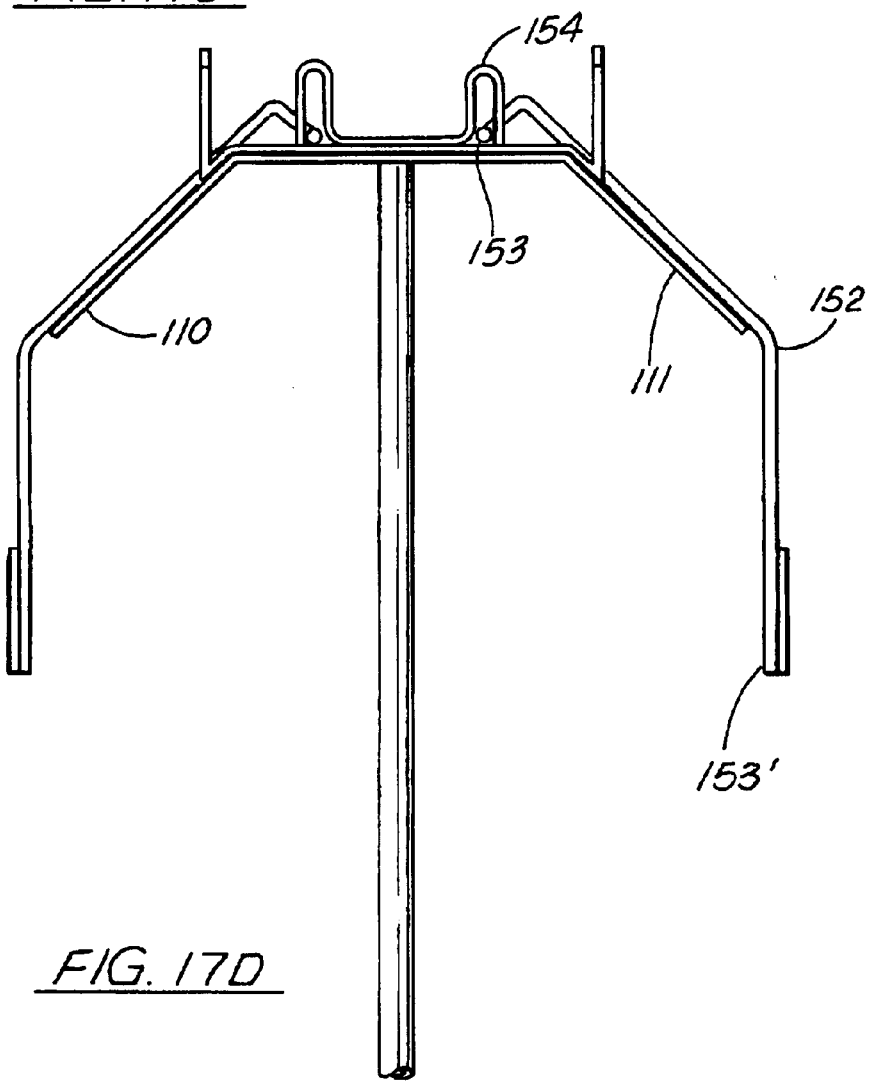
FIG. 17D is a side view of the bag rack of FIG. 17D.

As shown in FIG. 16B, the cover may include advertising A, or, as shown in FIG. 16A, the cover may include a pocket P or retaining means for allowing the placement of notices, advertising thereupon, or holding means for allowing the dispensing of coupons or bag ties therefrom.

Referring to FIGS. 13A–13D, the user 57 applies pressure 58 downward to the top bag in the bag pack through the dispensing aperture formed in the cover, utilizing the declining planer support area 23 to support the bag pack 24 and top bag 25, guiding the bag downward 59, urging the perforation apart and thereby separating 60 the bag from the tab, opening the mouth of the bag 25. The cover, besides framing the area which the user can effectively utilize the declining planer support area to dispense the top bag, also functions to apply pressure to the bag pack and bag being dispensed, holding via pressure 61 the bag pack in a flat, uniform position while the top bag is dispensed. The cover also holds the pack in a flat, uniform posture under windy conditions. It is noted that the dispensing aperture may have forms other than the rectangle shown, and may include other designs, including those, incorporating radial lines, depending upon the application and use of the system.

FIGS. 14A–14E illustrate an second embodiment for the rack of the present invention, wherein the stand 70 includes a vertical support 71 having first 72 and second 72' ends, the first end engaging a base 73, the second end engaging a rack portion 74, the rack portion further including first and second, opposing dispensing portions 75, 75', respectively. As shown, the body 76 of the rack is formed from sheet metal which is bent into shape, and which has punched out bag pack support member 77, 77' configured to engage and hold the bag pack in a manner similar to that indicated in the preferred embodiment of the invention. As shown, a third, medial support member 78 may be provided, depending upon the configuration of the pack to be dispensed.

Continuing with the drawings, the rack includes a declining planar support member emanating from the body at about the position of the support member 77, 77', which ideally would have a width 80 commensurate with the width of the bag pack to be dispensed.

Figure 15A:
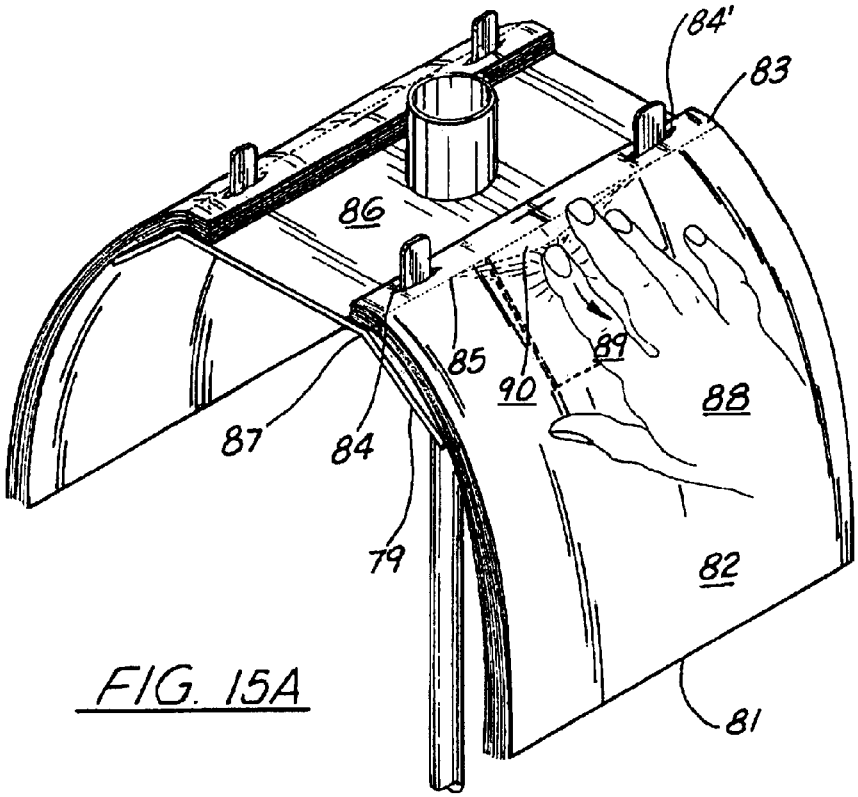
FIGS. 15A–15B illustrate isometric views of the rack of FIGS. 14A–14E, with bag packs mounted thereon, further illustrating sequential views of a user dispensing a bag from the pack.
Figure 15B:
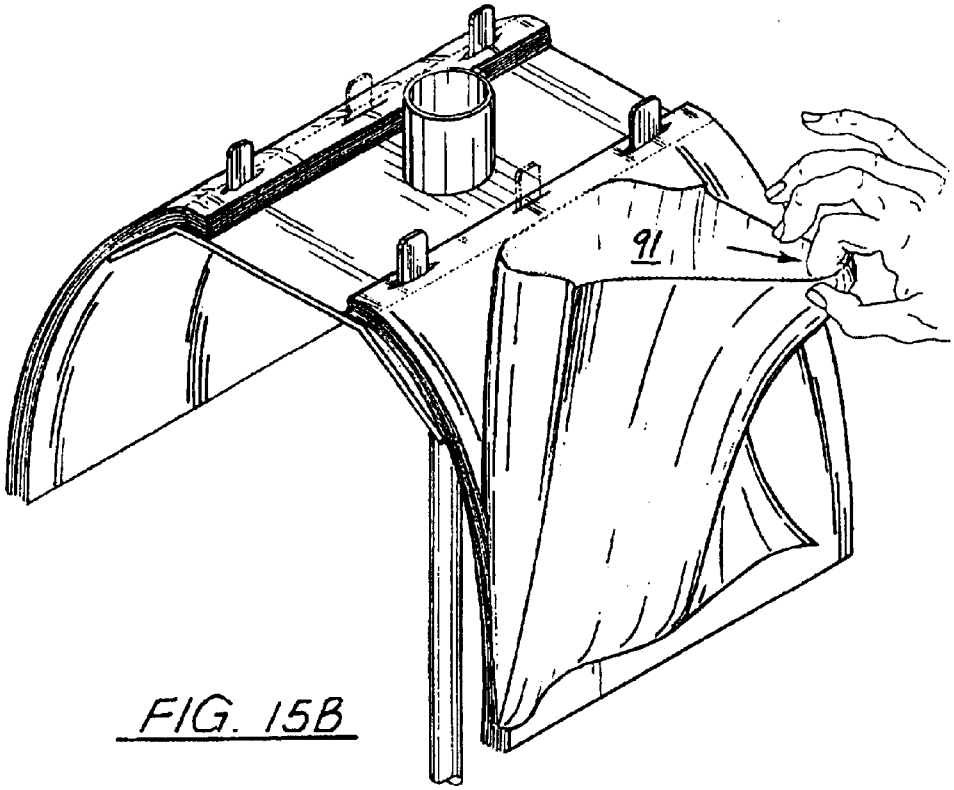

Referring to FIGS. 15A–15B, in use, a bag pack 81 comprising a stack of bags 82 held together via a fused tab portion 83 having support slits 84 formed therein, which bags may be separated from the tab portion via perforation 85, is placed upon the rack such that the support slits 84, 84'8 engage the support members 77, 77' of the rack with the perforation 85 of the bag pack supported above an angled transition zone 87 on the rack, wherein the rack goes from a generally horizontal 86, planar support to a declining support member 79.

A user 88 applies pressure 89 to the top bag, the pressure supported by the declining planar support member 79, then directs said pressure downward 90, so as to separate the top wall of the top bag from the tab via separating the perforation, thereby opening 91 the mouth of the bag, and allowing said top bag to be pulled and removed from the pack.

FIGS. 14A–14E illustrate an second embodiment for the rack of the present invention, wherein the stand 70 includes a vertical support 71 having first 72 and second 72' ends, the first end engaging a base 73, the second end engaging a rack portion 74, the rack portion further including first and second, opposing dispensing portions 75, 75', respectively. As shown, the body 76 of the rack is formed from sheet metal which is bent into shape, and which has punched out bag pack support member 77, 77' configured to engage and hold the bag pack in a manner similar to that indicated in the preferred embodiment of the invention. As shown, a third, medial support member 78 may be provided, depending upon the configuration of the pack to be dispensed.

Continuing with the drawings, the rack includes a declining planar support member emanating from the body at about the position of the support member 77, 77', which ideally would have a width 80 commensurate with the width of the bag pack to be dispensed.

Referring to FIGS. 15A–15B, in use, a bag pack 81 comprising a stack of bags 82 held together via a fused tab portion 83 having support slits 84 formed therein, which bags may be separated from the tab portion via perforation 85, is placed upon the rack such that the support slits 84, 84'8 engage the support members 77, 77' of the rack with the perforation 85 of the bag pack supported above an angled transition zone 87 on the rack, wherein the rack goes from a generally horizontal 86, planar support to a declining support member 79.

A user 88 applies pressure 89 to the top bag, the pressure supported by the declining planar support member 79, then directs said pressure downward 90, so as to separate the top wall of the top bag from the tab via separating the perforation, thereby opening 91 the mouth of the bag, and allowing said top bag to be pulled and removed from the pack.

FIGS. 17A–17D, 18A–18B, and 19A–19B illustrate a third embodiment of the present invention, wherein there is provided an alternative rack and bag pack cover configuration.

Referring to FIGS. 17A–17D, the third embodiment of the rack R' of the present invention includes a vertical support member 101 having first 102 and second 103 ends, the first end 102 engaging a base 104, the second end 103 supporting a top rack 105.

The top rack 105 includes first 110 and second 111, opposing dispenser stations, each dispenser station having a generally horizontally situated support section S formed of sheet metal and having emanating therefreom first 112 and second 112' support members.

As shown, the body of the rack is formed from sheet metal which is bent into shape, and which has punched out bag pack support members 112, 112' configured to engage and hold a bag pack in a manner similar to that indicated in the preferred embodiment of the invention. A third, medially situated support member may also be provided (not shown), depending upon the configuration of the pack to be dispensed.

Continuing with the drawings, the rack includes a declining planar support member 172 emanating from the body in the vicinity of support members 112, 112', which ideally would have a width 180 at least commensurate with the width of the bag pack to be dispensed, the declining planar support member situated at a declining angle from the end situated in the vicinity of the bag pack support members to the opposing end.

The present embodiment of the invention further incorporates a new and unique bag pack holding members 150, 151, configured to hold in place an underlying bag pack, while providing a dispensing area for guiding a user to remove the next bag to be dispensed in an open configuration.

As shown, each bag pack holding member 150 comprises first and second rods 152, 152' having first 153 and second 153' ends, each first end of the rods incorporating opposing laterally emanating end E pieces engaging a pivotal connecting slot 154, 154', each second end of the rods engaging opposing ends of a base plate 155. Each pivotal connecting slot 154 is formed to provide a vertical slot portion to engage the laterally emanating end piece, allowing a pivotal connection while allowing vertical migration of the lateral end piece and associated rod and bag pack cover assembly up or down the formed vertical slot, as it is urged via an underlying bag pack, as will be further discussed infra.

Figure 18A:
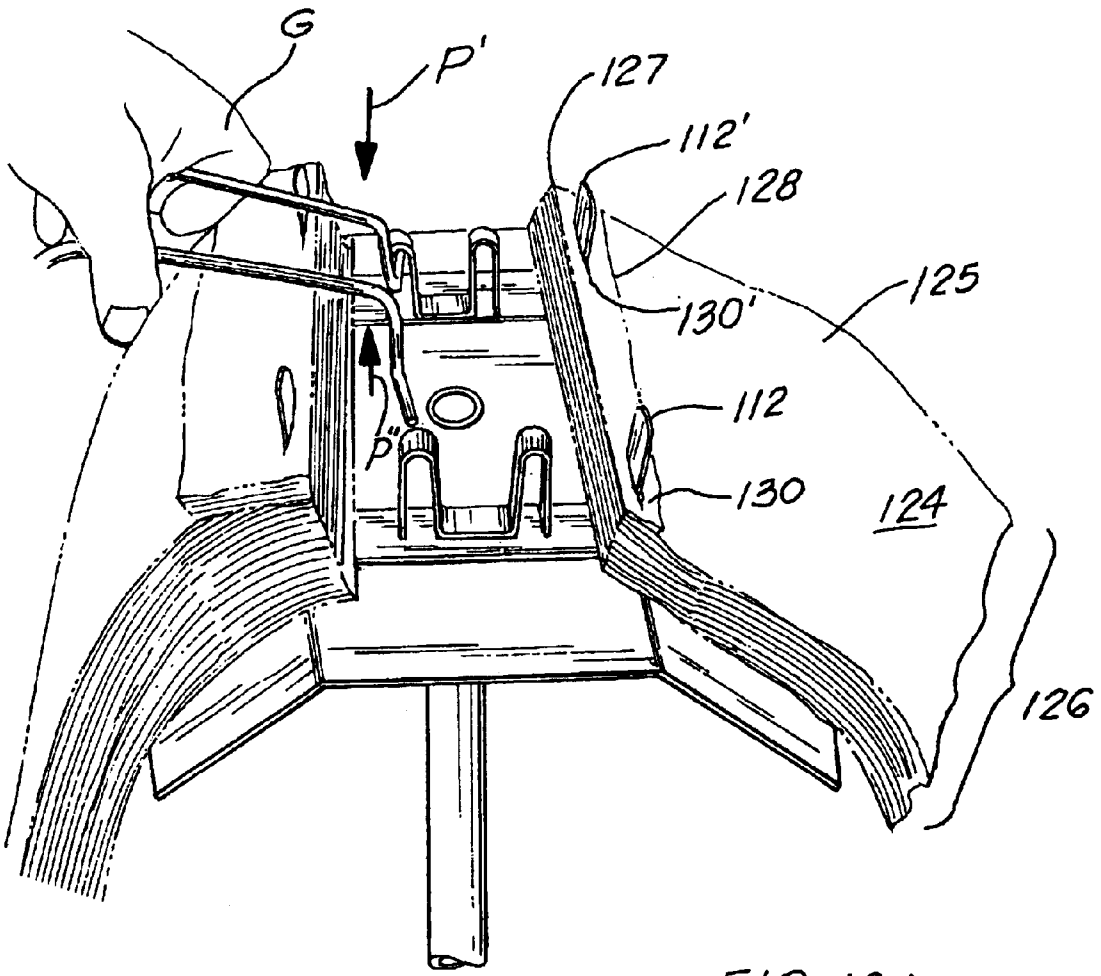
FIG. 18A is an isometric, upper view of the bag rack of FIG. 17A, further illustrating the installation of a bag pack thereupon.
Figure 18B:
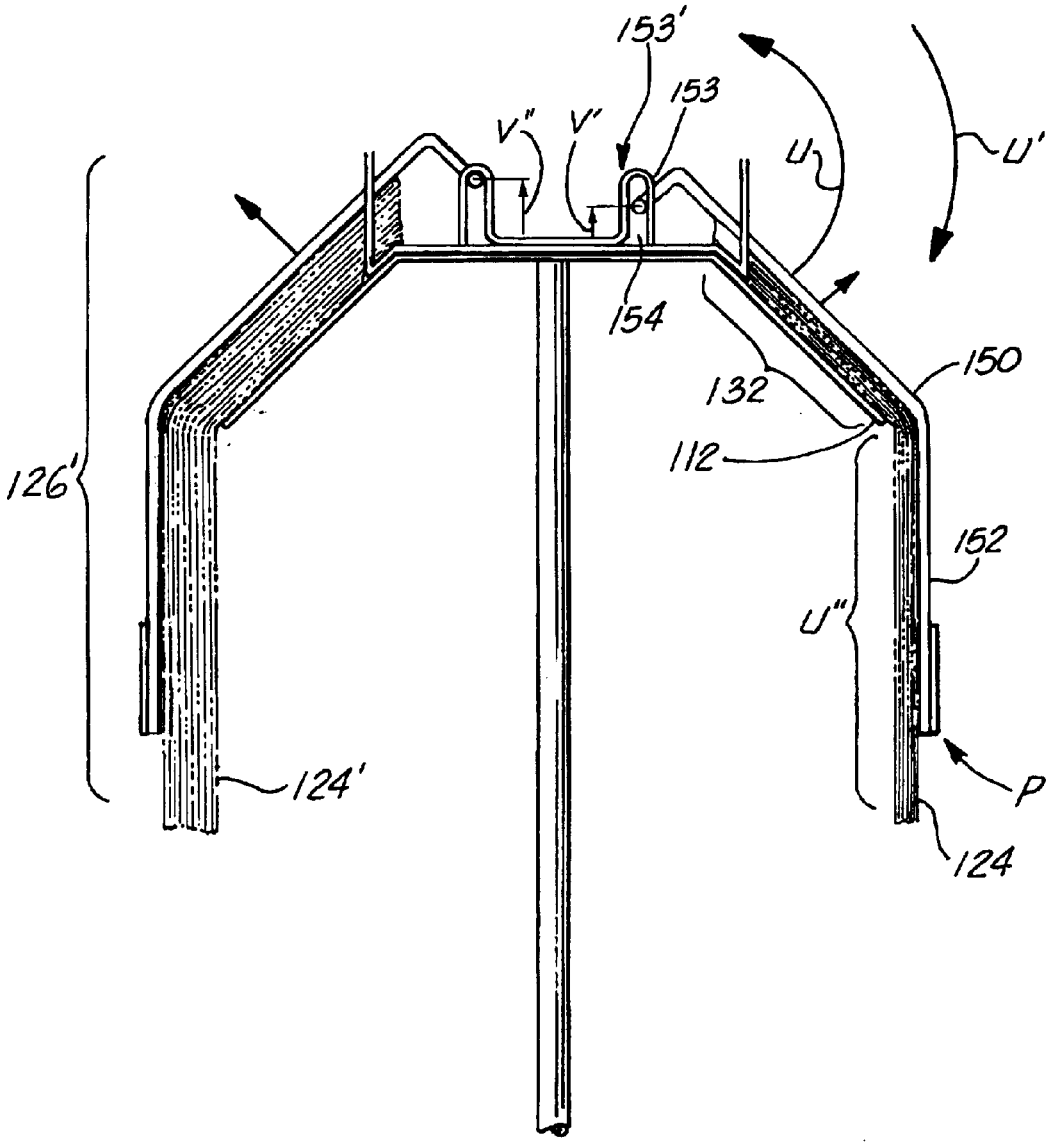
FIG. 18B is a side view of the bag rack of FIG. 18A, illustrating the bag pack covers resting upon the first and second bag packs, respectively.

Continuing with FIGS. 18A and 18B, the present system further includes a bag pack 124, 124' comprising a stack of bags including a top bag 125, each bag pack having a uniform width 126 and length 126'. The bags may be retained in a pack via a heat fused tab portion 127 removably connected to the upper edge forming the mouth of the bag via perforated line 128, the tab portion further having second and first support slits 130', 130 formed therethrough, configured to engage first and vertical support members 112, 112', respectively. As also shown, the declining planar support member 112 is configured to provide a supported dispensing area 132 under the bag pack for enhanced dispensing of individual bags from the bag stack by a user.

Continuing with the figures, in use, the bag pack holding member 150 may be pivoted upwards U via lifting the base plate (pivoting the first end of the rods engaging the vertically situated pivotal connection slot(s) 154) and placing P the bag pack thereunder, so that the support slits 130, 130' engage their respective vertical support members 112, 112', and the a bag pack holding member 150 is then pivoted downwardly U' to rest upon the bag pack. Accordingly, the first ends 153, 153' of the rods engaging the vertically situated pivotal connection slots may migrate vertically V', V" so that the rods rest generally flatly upon the surface of their respective bag packs. As shown, the rods may be angled in a generally medial portion of the rods to match the contour of the declining planar support member and unsupported portion of the bag pack U", so as to contact the uppermost bag in the bag pack along its length, holding the bag pack down and providing a stable dispensing area.

Referring to FIG. 18A, instead of pivoting the rods upward to install the bag pack, a user may merely grasp the two rods in the vicinity of their first ends and apply pressure P', P" towards each of said rods removing the lateral ends of the rods from the supporting pivotal connection slots, remove the bag pack holding member, install the bag pack as above, and reinstall the bag pack holding member by again grasping and applying pressure to the rods in the vicinity of their first ends, then placing the lateral ends of the rods in their respective pivotal connection slots by releasing same.

Figure 19A:
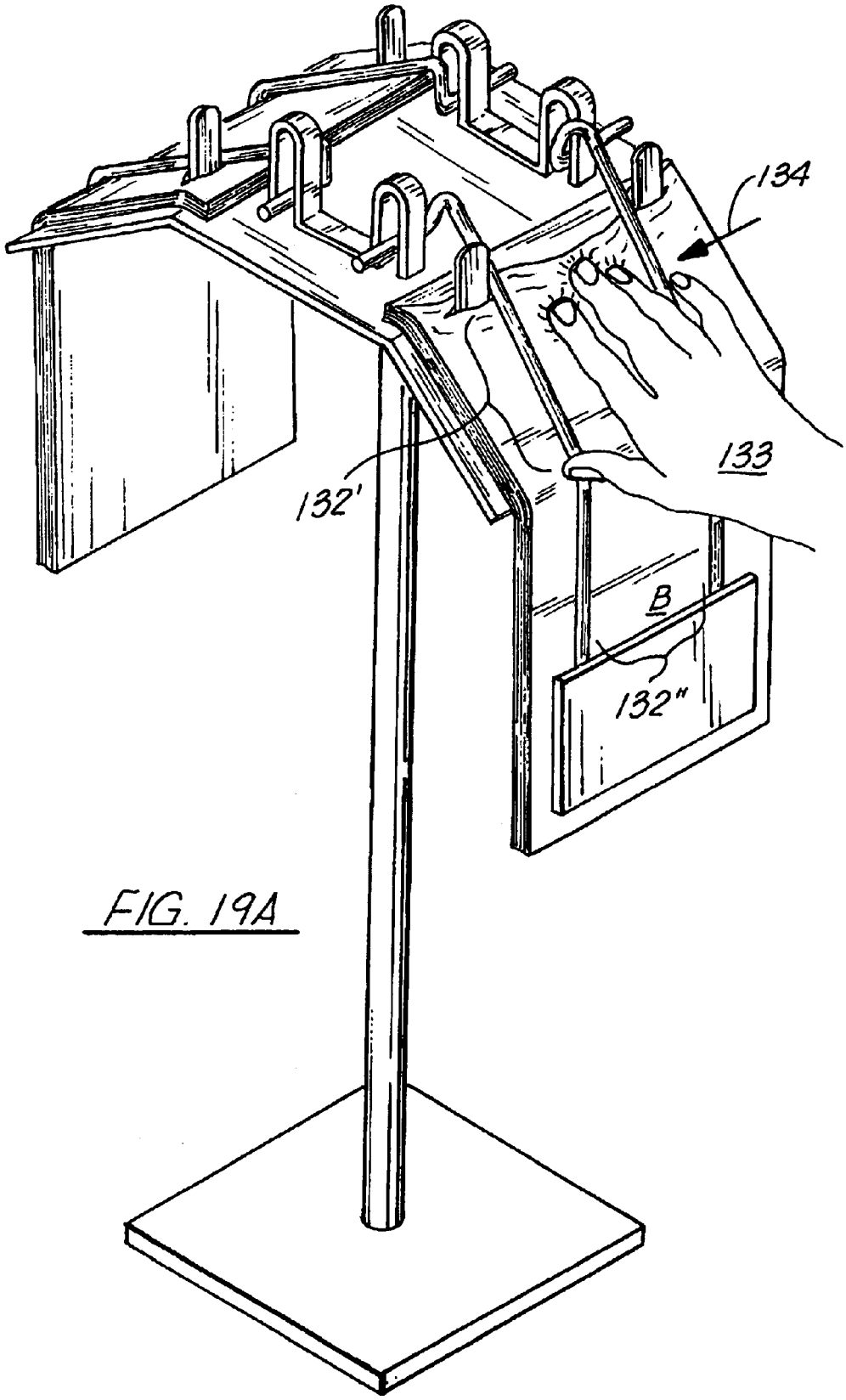
FIG. 19A is an isometric view of the bag pack of FIG. 18A, illustrating the dispensing of a bag between first and second rods of one of the bag pack covers.
Figure 19B:
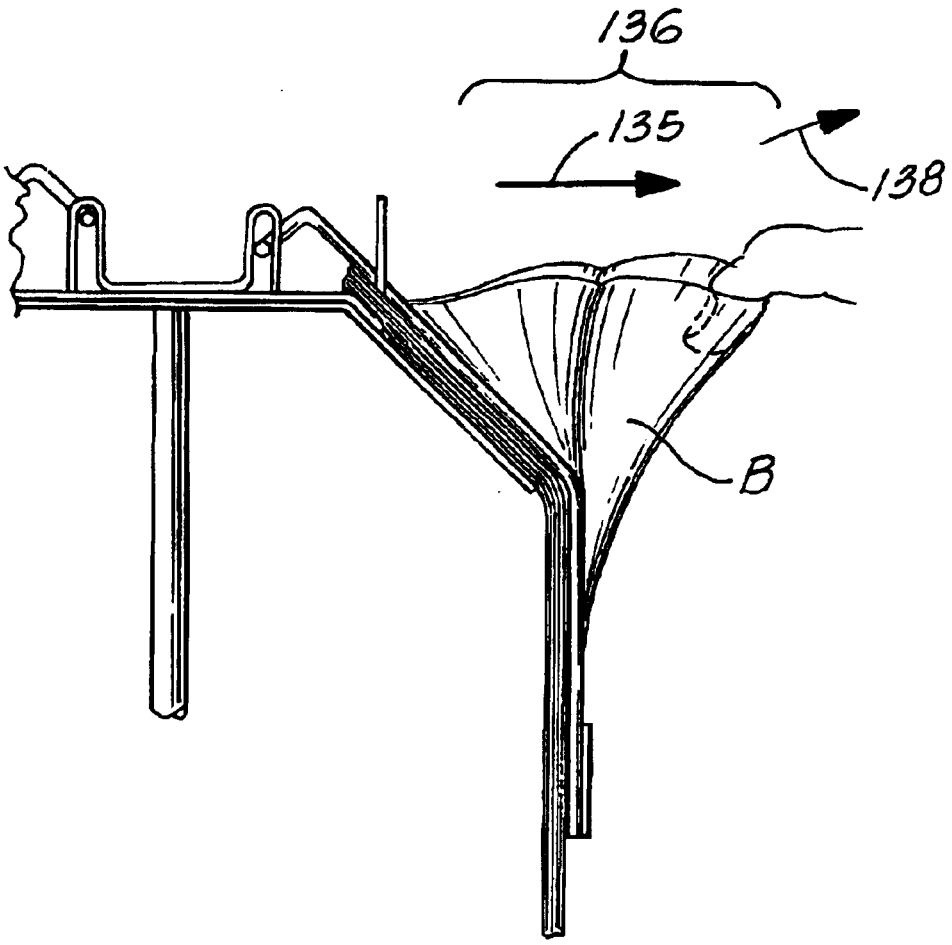
FIG. 19B is a side view of the dispensing of a bag of the invention of FIG. 19A.

Continuing with FIGS. 19A and 19B, in use, the user 133 applies pressure 134 to the top bag B within the supported dispensing area 132 over the planer support, so that the underlying declining planer support area supports the medial area 131 and supported dispensing area 132', 132" of the bag and bag pack, allowing the user to pull 135 the top wall of the bag toward the user, separating 136 the perforated portions, opening bag B, and removing and dispensing 138 same from the pack. In applying pressure to the bag to be dispensed, the user may utilize the underlying declining planer support area to support the bag pack and bag to be dispensed, detaching the perforation holding the top bag from the bag pack while guiding the bag downward, separating the bag from the pack.

As shown, the bag pack holding member forms therein a dispensing area 47 conforming to the dispensing area 132, 132", between the first and second rods and base plate, said first and second rods, and base framing the dispensing area and holding down the edges of the bag pack, providing a frictional means for facilitating the dispensing of the outer bag wall of the next bag to be dispensed. Accordingly, the present embodiment functions in a manner similar to the invention of FIGS. 12A and 12B and 13A–13D.

As with the other embodiments, the bag pack holding member also holds the pack in a flat, uniform posture under windy conditions. It is noted that the dispensing aperture may have forms other than the rectangle shown, and may include other designs, including those incorporating radial lines, depending upon the application and use of the system.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A rack for dispensing a plastic bag from a plurality of stacked plastic bags releaseably attached to a tab so as to form a pack, comprising:

first and second retaining means for releaseably retaining said tab so as to support said pack;

a medial planar support member situated in between said first and second retaining means, said medial planar support member having a declining planer support piece emanating in declining fashion relative to the horizontal at said first and second retaining means, said declining planer support piece formed so as to support said pack in order to enable a user to apply pressure to said plastic bag and receive underlying support from said declining planer support piece;

a dispensing frame comprising first and second rods having first and second ends, said first and second rods spaced in parallel fashion and pivotally connected to said medial planar support member at said first end, and a lower cover plate joining said second ends of said first and second rods, said dispensing frame configured to rest upon said pack so as to form a dispensing area defined between the first and second rods.

2. The system of claim 1, wherein said declining medial planar support member has an angle of forty-five degrees relative to the horizontal.

3. The system of claim 1, wherein said declining medial planar support member has a declining angle relative to the horizonal within a range of five to ninety degrees relative to the horizonal.

4. The system of claim 3, wherein said retaining means comprises first and second vertical support members.

5. The system of claim 4, wherein the tab forming said pack has formed therein first and second support slits situated so as to engage said first and second vertical support members.

6. The system of claim 5, wherein said tab engages said first and second retaining means via said first and second support slits, such that said pack is supported via said first and second retaining means, and said pack is supported via said declining planer support piece.

7. The system of claim 1, wherein said medial planar support member further comprises first and second vertical slot members configured to engage and support said first ends of said first and second rods.

8. The system of claim 7, wherein said first ends of said rods have laterally emanating members, and wherein said first and second vertical slot members each have formed therein a vertical slot, and wherein said laterally emanating members are configured to respectively slidingly and pivotally engage the vertical slot formed in said vertical slot members so as to facilitate the flat disposition of said dispenser frame upon an underlying pack mounted to said rack.

9. The system of claim 8, wherein said bags forming said bag pack are removably attached to said tab via a perforated line.

10. The system of claim 9, wherein said first and second retaining means and said medial planar support member forms a dispensing station, and wherein said dispensing station is supported via a vertical support having a base.

11. The method of dispensing a plastic bag from a plurality of stacked plastic bags releaseably attached to a tab so as to form a pack, comprising the steps of:

a) providing:

first and second retaining means for releaseably retaining said tab so as to support said pack;

a medial planar support member situated in between said first and second retaining means, said medial planar support member having a declining planer support piece emanating in declining fashion relative to the horizontal at said first and second retaining means, said declining planer support piece formed so as to support said pack in order to enable a user to apply pressure to said plastic bag and receive underlying support from said declining planer support;

a dispensing frame comprising first and second rods having first and second ends, said first and second rods spaced in parallel fashion and pivotally connected to said medial planar support member at said first end, and a lower cover plate joining said second ends of said first and second rods, said dispensing frame configured to rest upon said pack so as to form a dispensing area defined between the first and second rods;

said medial planar support member further comprising first and second vertical slot members configured to engage and support said first ends of said first and second rods of said dispensing frame so as to facilitate a sliding and pivotal engagement of the first ends of said first and second rods with the vertical slot formed in said respective first and second vertical slot members, so as to facilitate the flat disposition of said dispenser frame upon an underlying pack mounted to said rack;

b) affixing said pack to said retaining means such that said plastic bag is situated on top of said pack, and said declining planar support piece is situated under said pack;

c) applying pressure to said plastic bag in an area on said plastic bag where said plastic bag receives underlying support from said declining planer support piece, while utilizing said dispensing frame to direct the user to apply pressure to said plastic bag in an area on said plastic bag wherein said plastic bag receives underlying support from said declining planar support piece;

d) directing said pressure to said plastic bag away from said tab, so as to release said bag from said tab, with said declining planer support piece continuing to support said pack in the area in which said pressure is applied;

f) removing said bag from said rack.

12. The method of claim 11, wherein there is provided the further step of utilizing said dispensing frame to retain said pack in a uniform stack, by allowing said cover to apply pressure uniformly to said pack in windy conditions.

* * * * *